US010210874B2

(12) United States Patent
Chebiyyam et al.

(10) Patent No.: US 10,210,874 B2
(45) Date of Patent: Feb. 19, 2019

(54) MULTI CHANNEL CODING

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/884,136

(22) Filed: Jan. 30, 2018

(65) Prior Publication Data

US 2018/0226080 A1 Aug. 9, 2018

Related U.S. Application Data

(60) Provisional application No. 62/454,652, filed on Feb. 3, 2017.

(51) Int. Cl.

| | |
|---|---|
| ***G10L 19/008*** | (2013.01) |
| ***H04S 3/00*** | (2006.01) |
| *G10L 19/022* | (2013.01) |

(52) U.S. Cl.

CPC ..... *G10L 19/008* (2013.01); *H04S 3/008* (2013.01); *G10L 19/022* (2013.01)

(58) Field of Classification Search

None

See application file for complete search history.

(56) References Cited

U.S. PATENT DOCUMENTS

2012/0016680 A1* 1/2012 Thesing ..... G10L 19/008 704/500
2015/0221314 A1* 8/2015 Disch ..... G10L 19/025 704/500

FOREIGN PATENT DOCUMENTS

WO 2005073958 A1 8/2005
WO 2014128194 A1 8/2014

OTHER PUBLICATIONS

International Search Report and Written Opinion—PCT/US2018/016216—ISA/EPO—dated May 7, 2018.

* cited by examiner

*Primary Examiner* — Paul Huber
(74) *Attorney, Agent, or Firm* — Toler Law Group, P.C.

(57) ABSTRACT

A method includes generating a windowed time-domain mid channel by applying two first asymmetric windows to a first frame of a time-domain mid channel and applying two second asymmetric windows to a second frame of the time-domain mid channel. The method includes transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. The method includes performing an up-mix operation using the sets of transform-domain mid channel data, stereo parameters from the bit stream, and an interpolated parameter determined using an unevenly weighted interpolation between a first stereo parameter value associated with the first frame and a second stereo parameter value associated with the second frame.

51 Claims, 7 Drawing Sheets

MULTI CHANNEL CODING

I. CROSS REFERENCE TO RELATED APPLICATIONS

The present application claims priority from U.S. Provisional Patent Application No. 62/454,652 entitled "MULTI CHANNEL CODING," filed Feb. 3, 2017, which is incorporated herein by reference in its entirety.

II. FIELD

The present disclosure is generally related to audio coding.

III. DESCRIPTION OF RELATED ART

A computing device may include multiple microphones to receive audio signals. In a multichannel encode-decode system, a coder (e.g., an encoder, a decoder, or both) may be configured to function in one or more domains, such as a transform domain, a time domain, a hybrid domain, or another domain, as illustrative, non-limiting examples. In stereo-encoding, audio signals from the microphones may be encoded to generate a mid channel signal and one or more side channel signals. For example, when a stereo (2-channel) signal is coded, a set of spatial parameters can be estimated in one or more bands in a transform domain, such as a discrete Fourier transform (DFT) domain. Additionally or alternatively, another set of spatial parameters may be estimated in the time domain for one or more sub-frames. Other waveform coding may be performed in either the transform domain or the time domain. The mid channel signal may correspond to a sum of the first audio signal and the second audio signal. Additionally, in stereo-decoding, the mid channel signal and one or more side channel signals may be decoded to generate multiple output signals.

In multichannel encode-decode systems, a DFT transformation may be performed on audio signals to convert the audio signals from the time domain to the transform domain. The DFT transformation may be performed on a portion of an audio signal using a window (e.g., an analysis window). The window may include a look ahead portion that introduces some delay to the coding process (e.g., encoding and decoding). Delays introduced based on the look ahead portions of the encoding process and the decoding process contribute to a total amount of delay of the multichannel encode-decode system to encode and decode an audio signal.

IV. SUMMARY

In a particular implementation, a device includes a decoder configured to decode a bit stream to generate a time-domain mid channel. The decoder is also configured to generate a windowed time-domain mid channel by application of at least two first asymmetric windows to a first frame of the time-domain mid channel and application of at least two second asymmetric windows to a second frame of the time-domain mid channel. The decoder is further configured to transform the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. The decoder is also configured to perform an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame. The second frame is adjacent to the first frame.

In another particular implementation, a method includes decoding, at a decoder, a bit stream to generate a time-domain mid channel. The method also includes generating a windowed time-domain mid channel by applying at least two first asymmetric windows to a first frame of the time-domain mid channel and by applying at least two second asymmetric windows to a second frame of the time-domain mid channel. The method further includes transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. The method also includes performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame. The second frame is adjacent to the first frame.

In another particular implementation, a non-transitory computer-readable medium includes instructions that, when executed by a processor, cause the processor to perform operations including decoding, at a decoder, a bit stream to generate a time-domain mid channel. The operations also include generating a windowed time-domain mid channel by applying at least two first asymmetric windows to a first frame of the time-domain mid channel and by applying at least two second asymmetric windows to a second frame of the time-domain mid channel. The operations further include transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. The operations also include performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame. The second frame is adjacent to the first frame.

In another particular implementation, an apparatus includes means for decoding a bit stream to generate a time-domain mid channel. The apparatus also includes means for generating a windowed time-domain mid channel. The windowed time-domain mid channel is generated by applying at least two first asymmetric windows to a first frame of the time-domain mid channel and by applying at least two second asymmetric windows to a second frame of the time-domain mid channel. The apparatus further includes means for transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. The apparatus also includes means for performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame. The second frame is adjacent to the first frame.

Other aspects, advantages, and features of the present disclosure will become apparent after review of the application, including the following sections: Brief Description of the Drawings, Detailed Description, and the Claims.

V. BRIEF DESCRIPTION OF THE DRAWINGS

FIG. 1 a block diagram of a particular illustrative example of a system that includes a decoder operative to decode multiple audio signals;

Figure 1:
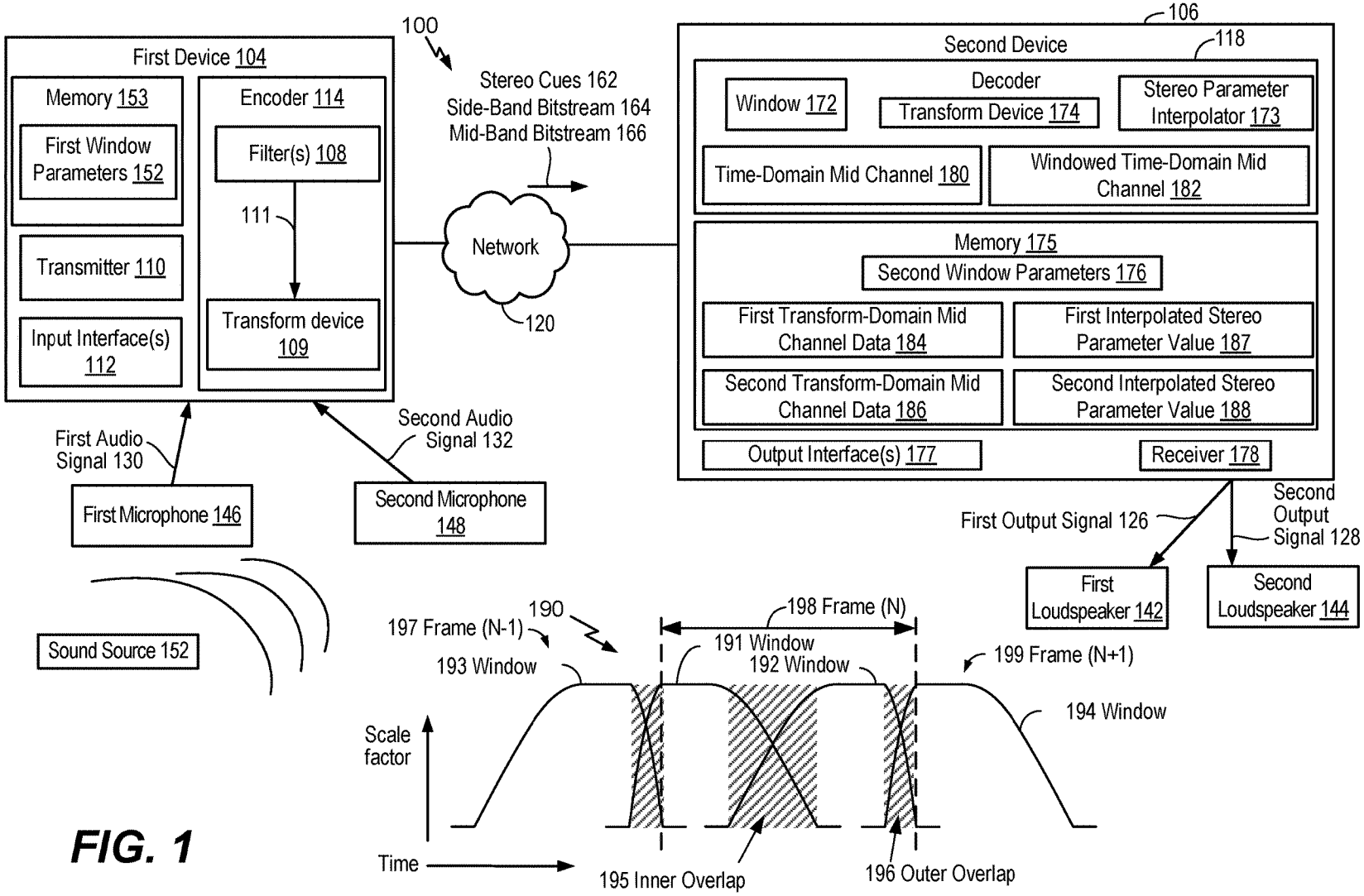
Figure 4:
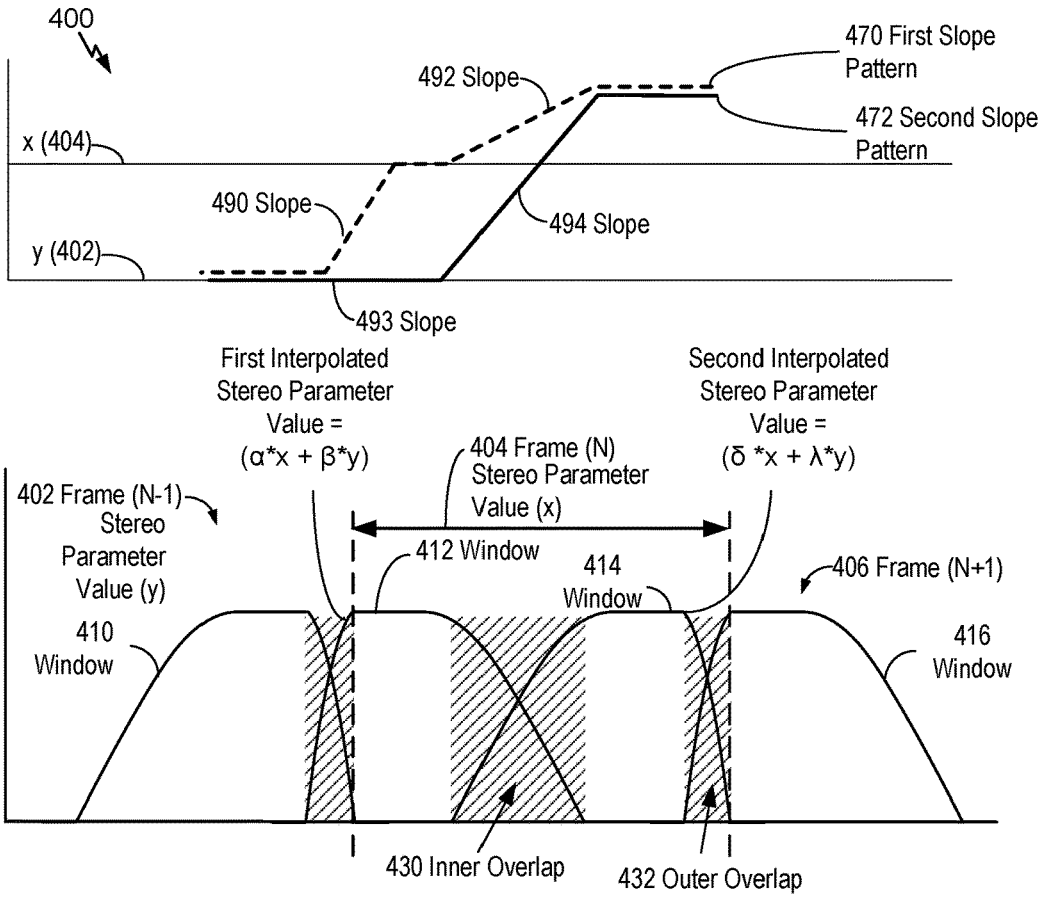
Figure 4:
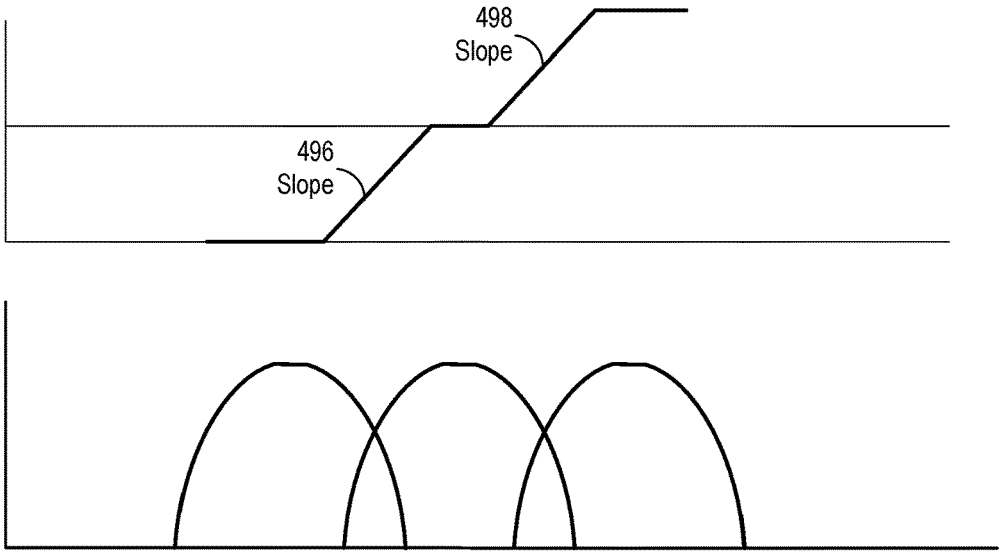
Figure 5:
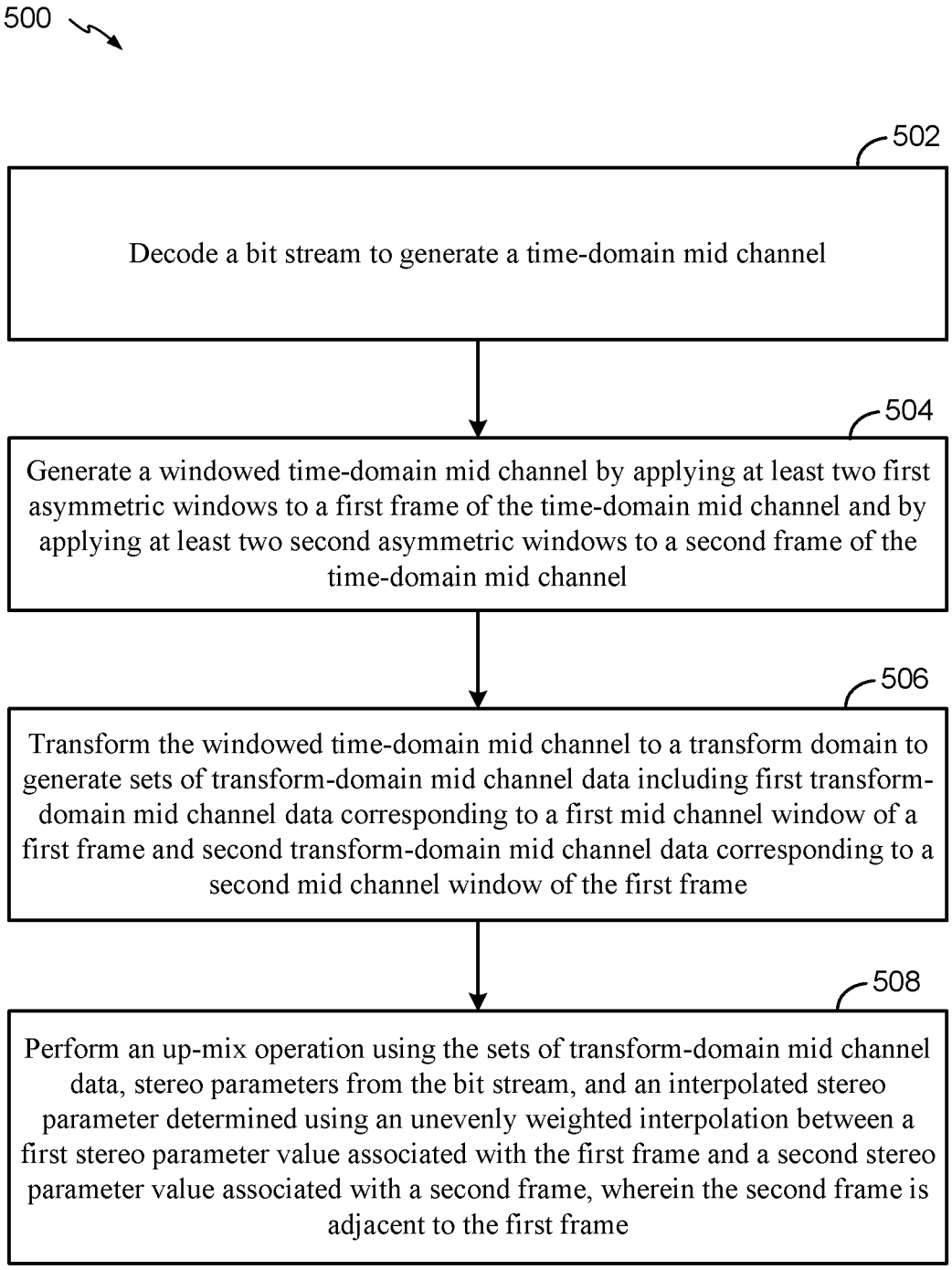
Figure 6:
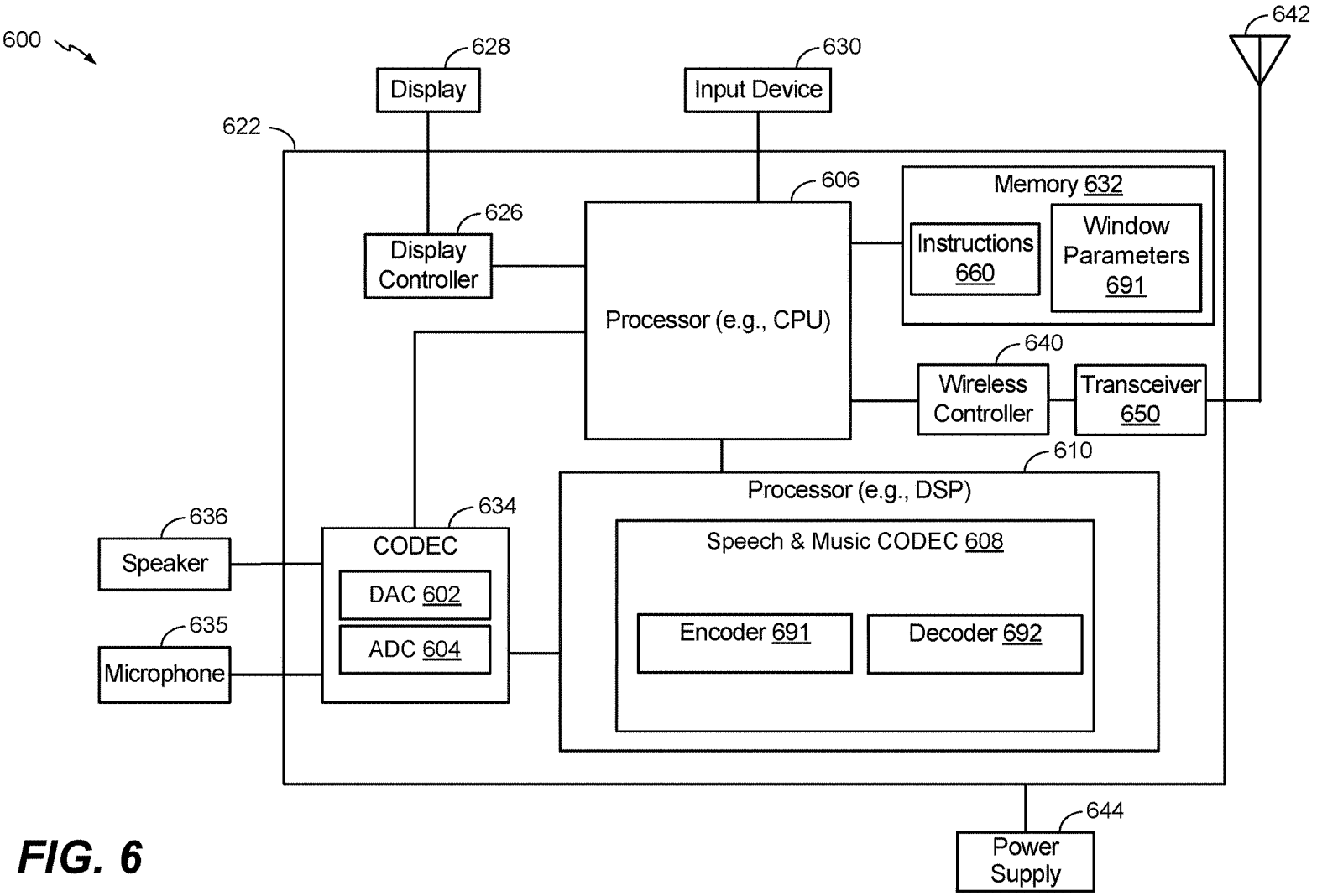
Figure 7:
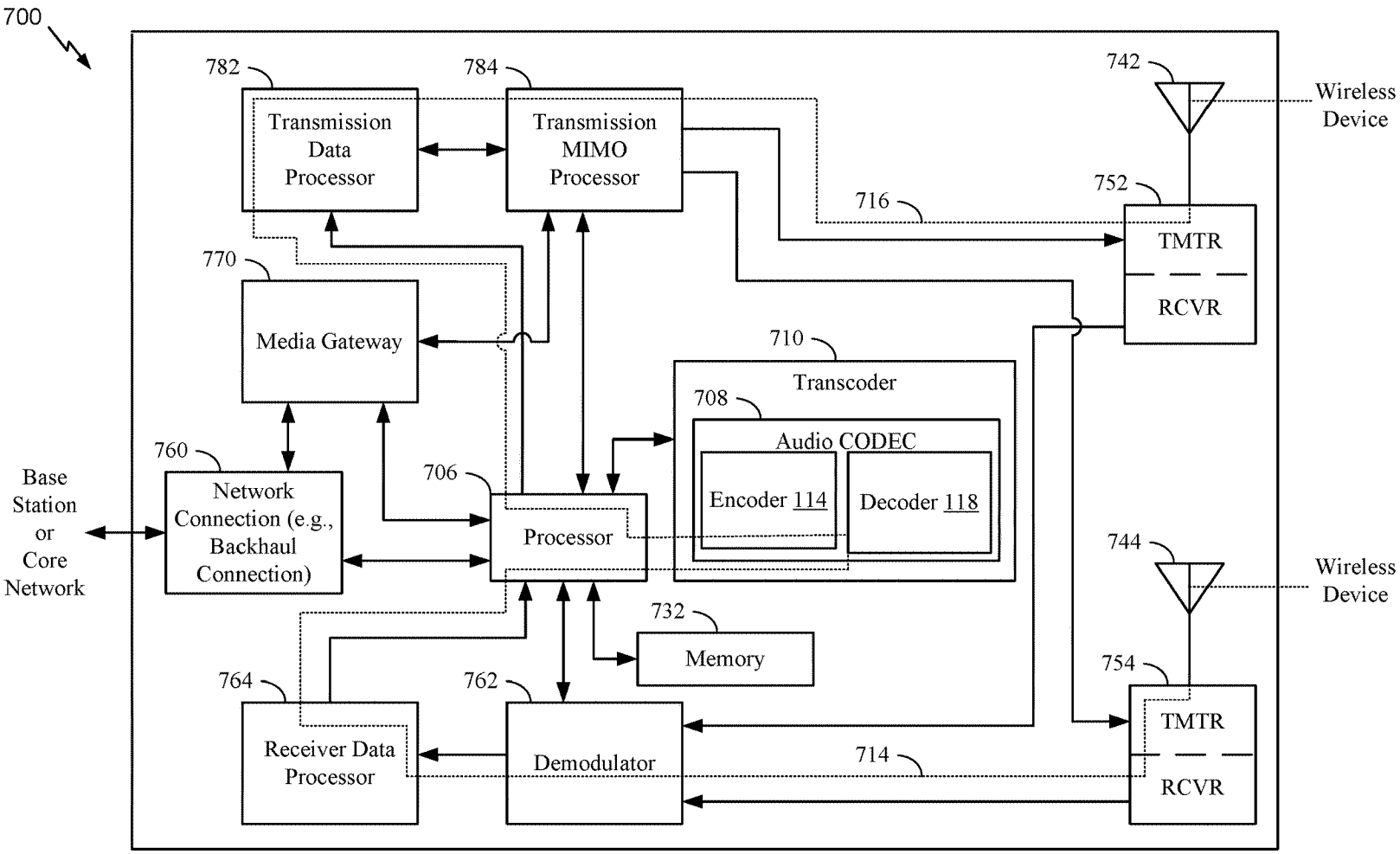

FIG. 4 includes an asymmetric windowing scheme applied by a decoder of the system of FIG. 1;

FIG. 5 is a flow chart illustrating an example of a method of operating a decoder;

FIG. 6 is a block diagram of a particular illustrative example of a device that is operable to encode multiple audio signals; and FIG. 7 is a diagram of a particular illustrative example of a base station that is operable to encode multiple audio signals.

VI. DETAILED DESCRIPTION

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise", "comprises", and "comprising" may be used interchangeably with "include", "includes", or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "using", "selecting", "accessing", and "determining" may be used interchangeably. For example, "generating", "calculating", or "determining" a parameter (or a signal) may refer to actively generating, calculating, or determining the parameter (or the signal) or may refer to using, selecting, or accessing the parameter (or signal) that is already generated, such as by another component or device.

In the present disclosure, systems and devices operable to code (e.g., encode, decode, or both) multiple audio signals are disclosed. In some implementations, encoder/decoder windowing may be mismatched for multichannel signal coding to reduce decoding delay, as described further herein.

A device may include an encoder configured to encode the multiple audio signals, a decoder configured to decode multiple audio signals, or both. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

In some systems, an encoder and a decoder may operate as a pair. The encoder may perform one or more operations to encode an audio signal, and the decoder may perform the one or more operations (e.g., in a reverse order) to generate a decoded audio output. To illustrate, each of the encoder and the decoder may be configured to perform a transform operation (e.g., a DFT operation) and an inverse transform operation (e.g., an IDFT operation). For example, the encoder may transform an audio signal from a time domain to a transform domain to estimate one or more parameters (e.g., Inter Channel stereo parameters) in transfer domain bands, such as DFT bands. The encoder may also waveform code one or more audio signals based on the estimated one or more parameters. As another example, the decoder may transform a received audio signal from a time domain to a transform domain prior to application of one or more received parameters to the received audio signal.

Prior to each transform operation and after each inverse transform operation, a signal (e.g., an audio signal) is "windowed" to generate windowed samples and the windowed samples are used to perform the transform operation or the inverse transform operation. As used herein, applying a window to a signal or windowing a signal includes scaling a portion of the signal to generate a time-range of samples of the signal. Scaling the portion may include multiplying the portion of the signal by values that correspond to a shape of a window.

At the decoder, for each frame of a multichannel signal, a method includes applying two asymmetric windows (i.e., a first window and a second window) to generate a windowed multichannel signal and transforming the windowed multichannel signal into a transform domain (e.g., a DFT domain) to generate transform-domain windowed data. In the transform domain, apply stereo parameters of the multichannel signal to the transform-domain windowed data by smoothing the stereo parameter values between adjacent frames using smoothing/interpolation (i.e., smoothing that, to calculate a stereo parameter value for data associated with the first window of a frame does not equally weight the stereo parameter values of the frame and the previous frame).

The decoder receives a bit stream that encodes a mid channel, stereo parameters, and additionally and optionally information to determine a side channel (e.g., the side channel or an error channel). The decoder decodes the bit stream to generate a time domain mid channel signal (and, in some cases, a time domain side channel signal). The time domain signals are windowed (i.e., a window function is applied to the time domain signals) to prepare the time domain signals for transformation to a transform domain (e.g., a DFT transform to a DFT domain). The windowed time domain signals are transformed to the transform domain to generate transform domain mid channel data (and, in some cases, a transform domain side channel data).

An up-mix operation is performed using the transform domain mid channel data and received or calculated transform domain side channel data to generate transform domain left and right channel data. The stereo parameters are applied during the up-mix operation. Only one value of each respective stereo parameter for each frame is provided in the bit stream. However, since two windows are used per frame, each frame of the time domain mid channel signal corresponds to two sets of transform domain mid channel data (e.g., two sets of mid channel coefficients per frame). Thus, a single stereo parameter per frame is used to determine two stereo parameter values per frame (one for data corresponding to the first window of the frame and another for data corresponding to the second window of the frame). For example, the stereo parameter value assigned to a frame may be applied to the second window, and a stereo parameter value to be applied to the first window of the frame may be interpolated. In some implementations, the interpolated stereo parameter value is determined by averaging (or evenly weighted smoothing) the stereo parameter value assigned to the frame and a stereo parameter value assigned to the previous frame. For example, the first window for the frame (N) uses a stereo parameter value midway between the stereo parameter value of the previous frame (N-1), and the stereo parameter value of the current frame (N). To illustrate, for frame (N) and parameter (P), this may be represented mathematically as:

$$P_window_2(N)=P(N);\text{ and}$$

$$P_window_1(N)=0.5*P(N)+0.5*P(N-1)$$

When the decoder uses asymmetric windows, evenly weighted smoothing may produce audio artifacts due to shorter overlap used between the two windows. Accordingly, to reduce or avoid these audio artifacts, unevenly weighted smoothing (e.g., both in time as well as in frequency bands based on a time-frequency grid) may be used with the asymmetric windows to offset the effect of unequal inner overlap (overlap of windows of a single frame) and outer overlap (overlap of a window of one frame with a window of an adjacent frame). The unevenly weighted smoothing applies unequal weights to determine a stereo parameter value to be applied to at least one of the set of transform domain data of a particular frame. For example, the unevenly weighted smoothing may be represented mathematically as:

$$P_window_2(N)=a*P(N)+b*P(N-1);\text{ and}$$

$$P_window_1(N)=c*P(N)+d*P(N-1)$$

where a, b, c, and d are smoothing coefficients. Generally, a+b=1 and c+d=1; however, to be unevenly weighted it is sufficient that a≠b and c≠b. In some implementations, all of the smoothing is applied to the first window (P_window_1), in which case a=1 and b=0. In other implementations, smoothing is applied to both windows of a frame, in which case a and b have non-zero values between 0 and 1. In such implementations, generally a>b and a>c.

Values of c and d may be selected based on differences in size of the outer overlap and the inner overlap. For example, since the inner overlap of the windows of a frame is larger than the outer overlap of the windows of the frame, the value of c may be less than the value of d. In other words, when applying the parameters, for a symmetric windowing case, the value of (P_window_2(N)−P_window_1(N))=(P_window_1(N)−P_window_2(N−1)). But in the case of asymmetrical windowing as described herein, (P_window_2(N)−P_window_1(N))≠(P_window_1(N)−P_window_2(N−1)).

In certain implementations, the values of a, b, c and d may be selected based on the side band rejection amounts of the two overlapping portions of the inner overlap and the outer overlap of the asymmetric windowing. As an illustrative example, when the inner overlap is larger than the side band rejection amount of the outer overlap, the side band rejection amount of the inner overlap is larger than the outer overlap. In this illustrative example, the value of a may be one and the value of b may be zero. With the knowledge that the side band rejection amount of the inner overlap is 'f' times the side band rejection amount of the outer overlap, c and d can be chosen such that d/c=f. If c+d=1, then c=f/(1+f) and d=1/(1+f). In another example implementation, the values of a, b, c, and d may be selected on a frame-by-frame basis based on the signal characteristic (e.g., based on whether the frame is inactive/background/noise, voiced, transient, music, or tonal content). For example, in the presence of a transient sound in the first frame or the second frame, the values of a, b, c, and d may be selected (or biased) differently than in the presence of a strongly voiced speech or music in the first frame or second frame. In certain other implementations, the values a, b, c, and d may be different for different stereo parameters (e.g., inter-channel level differences ILD, inter-channel phase differences, IPD).

Determining and applying the stereo parameters for each set of transform domain data and performing the up-mix operation results in two sets of transform domain left channel data per frame and two sets of transform domain right channel data per frame. An inverse transform operation may be performed to generate left and right channel time domain signals. Synthesis windows (having substantially the same asymmetric shape as previously applied by the decoder before the transform operation) are applied to the left and right channel time domain signals and overlapping portions of adjacent windows are added together to generate left and right channel signals that are ready to be played out.

Referring to FIG. 1, a particular illustrative example of a system 100 is depicted. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interface(s) 112 may be coupled to a first microphone 146. A second input interface of the input interface(s) 112 may be coupled to a second microphone 148. The encoder 114 may include one or more filter-banks (e.g., a filter 108) and a transform device 109 and may be configured to encode multiple audio signals, as described herein.

The first device 104 may also include a memory 153 configured to store first encoder window parameters 152. The first window parameters 152 may define a first window or a first windowing scheme 202 to be applied to at least a portion of an audio signal, such as the first audio signal 130 or the second audio signal 132. For example, the filter 108 may be a frequency resampling filter. In some example implementations, the filter 108 may be a high-pass filter to attenuate the DC or, for example, frequencies below 50-60 Hz. The encoder 114 may apply a first window (based on the first window parameters 152) to at least a portion of an audio signal to generate windowed samples 111 that are provided to the transform device 109. The transform device 109 may be configured to perform a transform operation, such as a transform operation (e.g., a DFT operation) or an inverse transform operation (e.g., an IDFT operation), on the windowed samples.

The second device 106 may include a decoder 118, a memory 175, a receiver 178, one or more output interfaces 177, or a combination thereof. The receiver 178 of the second device 106 may receive an encoded audio signal (e.g., one or more bit streams), one or more parameters, or both from the first device 104 via the network 120. The decoder 118 may include one or more windowing units (e.g., a window 172), a stereo parameter interpolator 173, and a transform device 174, and may be configured to render the multiple channels. The second device 106 may be coupled to a first loudspeaker 142, a second loudspeaker 144, or both.

The memory 175 may be configured to store second window parameters 176. The second window parameters 176 may define a second window or a second decoder windowing scheme (e.g., a asymmetric windowing scheme) to be applied by the window 172 to at least a portion of an audio signal, such as an encoded audio signal (e.g., that is synthesized at the decoder). For example, the window 172 may apply a second window (based on the second window parameters 176) to at least a portion of an encoded audio signal to generate asymmetric windowed samples that are provided to the transform device 174. The transform device 174 may be configured to perform a transform operation, such as a transform operation (e.g., a DFT operation) or an inverse transform operation (e.g., an IDFT operation), on the asymmetric windowed samples.

The first window parameters 152 (of the first device 104) used by the encoder 114 and the second window parameters 176 (of the second device 106) used by the decoder 118 may be mismatched. For example, the first window (defined by the first window parameters 152) may differ from the second window (defined by the second window parameters 176) in terms of a window's overlapping portion size (e.g., a look ahead amount), an amount of zero padding, a window's hop size, a window's center, a size of a flat portion of the window, a window's shape, or a combination thereof, as illustrative, non-limiting examples. In some implementations, the first window is used by the encoder 114 to generate first windowed samples (e.g., symmetric windowed samples) and the second window is used by the decoder 118 to generate second windowed samples (e.g., asymmetric windowed samples). The first windowed samples and the second windowed samples may have the same frequency resolution or may have different frequency resolutions.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. In some implementations, a sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132. In some implementations, the encoder 114 may be configured to adjust (e.g., shift) at least one of the first audio signal 130 or the second audio signal 132 to temporally align the first audio signal 130 and the second audio signal 132 in time. For example, the encoder 118 may shift a first frame (of the first audio signal 130) with respect to a second frame (of the second audio signal 132).

The encoder 114 may apply a first window (based on the first window parameters 152) to at least a portion of an audio signal to generate windowed samples 111 that are provided to the transform device 109. The windowed samples 111 may be generated in a time-domain. The transform device 109 (e.g., a frequency-domain stereo coder) may transform one or more time-domain signals, such as the windowed samples (e.g., the first audio signal 130 and the second audio signal 132), into frequency-domain signals. The frequency-domain signals may be used to estimate stereo cues 162. The stereo cues 162 may include parameters that enable rendering of spatial properties associated with left channels and right channels. According to some implementations, the stereo cues 162 may include parameters such as interchannel intensity difference (IID) parameters (e.g., interchannel level differences (ILDs), interchannel time difference (ITD) parameters, interchannel phase difference (IPD) parameters, interchannel correlation (ICC) parameters, non-causal shift parameters, spectral tilt parameters, inter-channel voicing parameters, inter-channel pitch parameters, inter-channel gain parameters, etc., as illustrative, non-limiting examples). The stereo cues 162 may be used at the transform device 109 during generation of other signals. The stereo cues 162 may also be transmitted as part of an encoded signal. Estimation and use of the stereo cues 162 is described in greater detail with respect to FIG. 2.

The encoder 114 may also generate a side-band bit stream 164 and a mid-band bit stream 166 based at least in part on the frequency-domain signals. For purposes of illustration, unless otherwise noted, it is assumed that that the first audio signal 130 is a left-channel signal (l or L) and the second signal 132 is a right-channel signal (r or R). The frequency-domain representation of the first audio signal 130 may be noted as $L_{fr}(b)$ and the frequency-domain representation of the second audio signal 132 may be noted as $R_{fr}(b)$, where b represents a band of the frequency-domain representations. According to one implementation, a side-band signal $S_{fr}(b)$ may be generated in the frequency-domain from frequency-domain representations of the first audio signal 130 and the second audio signal 132. For example, the side-band signal $S_{fr}(b)$ may be expressed as $(L_{fr}(b)-R_{fr}(b))/2$ or $(L_{fr}(b)-g*R_{fr}(b))/2$ where g is a normalizing gain parameter which may be based on the ILD calculated for the band b. The side-band signal $S_{fr}(b)$ may be provided to a side-band encoder to generate the side-band bit stream 164. According to one implementation, a mid-band signal m(t) may be generated in the time-domain and transformed into the frequency-domain. For example, the mid-band signal m(t) may be expressed as (l(t)+r(t))/2. Generating the mid-band signal and the side-band signal is described in greater detail with respect to FIG. 2. The time-domain/frequency-domain mid-band signals may be provided to a mid-band encoder to generate the mid-band bit stream 166.

The side-band signal $S_{fr}(b)$ and the mid-band signal m(t) or $M_{fr}(b)$ may be encoded using multiple techniques. According to one implementation, the time-domain mid-band signal m(t) may be encoded using a time-domain technique, such as algebraic code-excited linear prediction (ACELP), with a bandwidth extension for higher band coding. Before side-band coding, the mid-band signal m(t) (either coded or uncoded) may be converted into the frequency-domain (e.g., the transform-domain) to generate the mid-band signal $M_{fr}(b)$.

One implementation of side-band coding includes predicting a side-band $S_{PRED}(b)$ from the frequency-domain mid-band signal $M_{fr}(b)$ using the information in the frequency mid-band signal $M_{fr}(b)$ and the stereo cues 162 (e.g., ILDs) corresponding to the band (b). For example, the predicted side-band $S_{PRED}(b)$ may be expressed as $M_{fr}(b)*(ILD(b)-1)/(ILD(b)+1)$. An error signal e(b) in the band (b) may be calculated as a function of the side-band signal $S_{fr}(b)$ and the predicted side-band $S_{PRED}(b)$. For example, the error signal e(b) may be expressed as $S_{fr}(b)-S_{PRED}(b)$. The error signal e(b) may be coded using transform-domain coding techniques to generate a coded error signal $e_{CODED}(b)$. For upper-bands, the error signal e(b) may be expressed as a scaled version of a mid-band signal $M_PAST_{fr}(b)$ in the band (b) from a previous frame. For example, the coded error signal $e_{CODED}(b)$ may be expressed as $g_{PRED}(b)*M_PAST_{fr}(b)$, where, in some implementations, $g_{PRED}(b)$ may be estimated such that an energy of $e(b)-g_{PRED}(b)*M_PAST_{fr}(b)$ is substantially reduced (e.g., minimized).

The transmitter 110 may transmit the stereo cues 162, the side-band bit stream 164, the mid-band bit stream 166, or a combination thereof, via the network 120, to the second device 106. Alternatively, or in addition, the transmitter 110 may store the stereo cues 162, the side-band bit stream 164, the mid-band bit stream 166, or a combination thereof, at a device of the network 120 or a local device for further processing or decoding later.

The decoder 118 may perform decoding operations based on the stereo cues 162, the side-band bit stream 164, and the mid-band bit stream 166. For example, the decoder 118 may be configured to decode the mid-band bit stream 166 to generate a time-domain mid channel 180. The window 172 may generate a windowed time-domain mid channel 182 by applying two asymmetric windows to each frame of the time-domain mid channel. For example, the window 172 may use the second window parameters 176 to generate the windowed time-domain mid channel 182.

To illustrate, an example of an asymmetric windowing scheme 190. The time-domain mid channel 180 includes a frame (N−1) 197, a frame (N) 198, and a frame (N+1) 199. According to the windowing scheme 190, two asymmetric windows may be applied to each frame 197, 198, 199. To illustrate, an asymmetric window 191 may be applied to a first portion of the frame 198, and an asymmetric window 192 may be applied to a second portion of the frame 198. Additionally, an asymmetric window 193 may be applied to a second portion of the frame 197, and an asymmetric window 194 may be applied to a first portion of the frame 199. For ease of illustration, the asymmetric window applied to a first portion of the frame 197 is not shown, and the asymmetric window applied to a second portion of the frame 199 is not shown. The asymmetric windows 191, 192 may overlap to generate an inner overlap 195 for the frame 198. The asymmetric windows 192, 194 may overlap to generate an outer overlap 196 for the frame 198. Because the windows 191, 192, 194 are asymmetric, the inner overlap 195 is larger than the outer overlap 196 for the frame 198.

The asymmetric "window drifting" may be caused by a deeper inner overlap (e.g., the inner overlap 195) and a shorter outer overlap (e.g., the outer overlap 196) that distributes the interpolation strength from frame to frame. At the encoder 114, the interpolation may be uniformly performed across each window. At the decoder 118, the interpolation/smoothing may be restricted or biased to one per frame, and the interpolation/smoothing may be aligned according to the instance where there is a deeper window overlap. Further, the interpolation/smoothing parameters at the decoder 118 may be computed such that the window location where the stereo parameters are estimated at the encoder 114 closely aligns with the window location where the stereo parameters are applied in the up-mix process at the decoder 118.

After generation of the windowed time-domain mid channel 182, the transform device 174 may be configured to transform the windowed time-domain mid channel 182 to a transform domain to generate sets of transform-domain mid channel data. As a non-limiting example, the transform device 174 may perform a Discrete Fourier Transform (DFT) operation to transform the windowed time-domain mid channel 182 to the transform domain (e.g., a DFT domain). According to one implementation, the sets of transform-domain mid channel data may include first transform-domain mid channel data 184 corresponding to a first mid channel window (e.g., window 191) of a first frame (e.g., frame 198) and second transform-domain mid channel data 186 corresponding to a second mid channel window (e.g., window 192) of the first frame.

The decoder 118 may be configured to perform an up-mix operation using the sets of transform-domain mid channel data, the stereo parameters (e.g., the stereo cues 162) from the bit stream, and an interpolated stereo parameter determined using an unevenly weighted interpolation between a first stereo parameter value (x) associated with the first frame (e.g., frame 198) and a second stereo parameter value (y) associated with a second frame (e.g., frame 197). For example, the stereo parameter interpolator 173 may be configured to determine a first interpolated stereo parameter value 187 for the first mid channel window (e.g., the window 191) based on a sum of a first product and a second product. The first product may be based on a first interpolation weight (α) and the first stereo parameter value (x), and the second product may be based on a second interpolation weight (β) and the second stereo parameter value (y). Thus, the first interpolated stereo parameter value 187 may be expressed as (α*x+β*y). The first interpolation weight (α) and the second interpolation weight (β) may be unequal such that the interpolation is unevenly weighted. The decoder 118 may be configured to apply the first interpolated stereo parameter value 187 to the first mid channel window (e.g., the window 191) during the up-mix operation. For example, the decoder 118 may apply an interpolated version of the stereo cues 162 (generated at the encoder 114) to the first mid channel window (e.g., to a frequency-domain signal).

According to some implementations, the first interpolation weight (α) and the second interpolation weight (β) are adaptively weighted across different frames based on transients detected by the encoder 114. To illustrate, the encoder 114 may detect a transient, such as a rapid increase (e.g., "pop") in volume from frame-to-frame. Based on the transient, the stereo parameters value may have a rapid change from frame-to-frame. Thus, in the scenario of a detected transient, the value of the first interpolation weight ($\alpha$) may be higher (e.g., weighted heavier) for a particular frame than a value of the first interpolation weight ($\alpha$) for a preceding frame. Similarly, the value of the second interpolation weight ($\beta$) may be lower (e.g., weighted lower) for the particular frame than a value of the second interpolation weight ($\beta$) for the preceding frame.

The stereo parameter interpolator 173 may also be configured to determine a second interpolated stereo parameter value 188 for the second mid channel window (e.g., the window 192) based on a sum of a third product and a fourth product. The third product may be based on a third interpolation weight ($\delta$) and the first stereo parameter value (x), and the fourth product may be based on a fourth interpolation weight ($\lambda$) and the second stereo parameter value (y). Thus, the second interpolated stereo parameter value 188 may be expressed as ($\delta$*x+$\lambda$*y). The decoder 118 may be configured to apply the second interpolated stereo parameter value 188 to the second mid channel window (e.g., the window 192) during the up-mix operation. For example, the decoder 118 may apply an interpolated version of the stereo cues 162 (generated at the encoder 114) to the second mid channel window (e.g., to a frequency-domain signal).

The third interpolation weight ($\delta$) may be greater than or equal to the first interpolation weight ($\alpha$), and the fourth interpolation weight ($\lambda$) may be less than the second interpolation weight ($\beta$). As a result, the second interpolated stereo parameter value 188 may be weighted heavier towards the first stereo parameter value (x) (e.g., the stereo parameter value associated with the frame 198), and the first interpolated stereo parameter value 187 may be weighted heavier towards the second stereo parameter value (y) (e.g., the stereo parameter value associated with the frame 197). According to one implementation, the third interpolation weight ($\delta$) is equal to one and the fourth interpolation weight ($\lambda$) is equal to zero. In this implementation, the second interpolated stereo parameter value 188 is equal to the first stereo parameter value (x).

The first interpolation weight ($\alpha$), the second interpolation weight ($\beta$), the third interpolation weight ($\delta$), and the fourth interpolation weight ($\lambda$) may be distinct from the interpolation weights for corresponding windows used, the by encoder 114, to generate the bit stream. To elucidate, in view of the different windowing schemes used at the encoder and the decoder, the interpolation schemes performed at the encoder and at the decoder may be different. As an example, when the encoder uses the stereo parameter value x on a certain window corresponding to the frame N and uses the parameter value y on the corresponding window of frame N−1, and when the encoder uses a certain interpolation scheme such as $\alpha_e$*x+$\beta_e$*y for the other window corresponding to frame N during the downmix operation, the decoder may still use the same parameter value x for certain window of frame N and the parameter value y for the corresponding window of frame N−1. But, the decoder may use an interpolation scheme such as ($\alpha$*x+$\beta$*y) for the parameter to be used for the other window of frame N where, $\alpha$ is not the same as $\alpha_e$ or $\beta$ is not the same as $\beta_e$, or both. It should be noted that in some implementations, the window locations where x and y are applied on the decoder and encoder may not be the same, hence the window locations where $\alpha_e$*x+$\beta_e$*y and $\alpha$*x+$\beta$*y are applied are also not the same. In other words, for the case when $\alpha_e$=$\beta_e$=0.5, (x−$\alpha_e$*x+$\beta_e$*y)=($\alpha_e$*x+y−($\beta_e$*y). But, on the decoder, (x−$\alpha$*x+$\beta$*y)≠($\alpha$*x+y−$\beta$*y). Thus, the difference between x and y is not split in the same ratio when applying interpolated parameters on the decoder as on the encoder.

According to another implementation, three or more windows may be generated for each frame, where at least two of the windows are asymmetric. As a non-limiting example, a first window of the frame may be asymmetric, a middle window of the frame may be asymmetric, and a last window of the frame may be symmetric. As another non-limiting example, the first window may be asymmetric, the middle window may be symmetric, and the last window may be asymmetric. There may be multiple inner overlaps for each frame and one outer overlap between the frame and an adjacent frame. The inner overlaps may have higher overlap lengths than the outer overlap, and a delay associated with the outer overlap may be relatively low. The parameter value of x on the last window may be used and the parameter value y on the last window of the previous frame may be used. The difference between x and y may not be uniformly spread across all of the windows between the last window of the current frame and the last window of the previous frame. Rather, the first window of the current frame may be disproportionately closer to y.

After applying the stereo cues 162, the decoder 118 may generate a first output signal 126 (e.g., corresponding to first audio signal 130), a second output signal 128 (e.g., corresponding to the second audio signal 132), or both. For example, the decoder 118 may also be configured to generate left channel data and right channel data based on the up-mix operations. The decoder 118 may perform a first inverse transform operation on the left channel data to generate a left time-domain channel, and the decoder 118 may perform a second inverse transform operation on the right channel data to generate a right time-domain channel. According to one implementation, the first inverse transform operation includes a first Inverse Discrete Fourier Transform (IDFT) operation, and the second inverse transform operation includes a second IDFT operation. The decoder 118 may also generate an output based on the left time-domain channel and the right time-domain channel. For example, the second device 106 may output the first output signal 126 via the first loudspeaker 142. The second device 106 may output the second output signal 128 via the second loudspeaker 144. In alternative examples, the first output signal 126 and second output signal 128 may be transmitted as a stereo signal pair to a single output loudspeaker.

According to one implementation, decoder 118 may operate in a similar manner with respect to a side channel as described above with respect to the mid channel. For example, the decoder 118 may be configured to generate a time-domain side channel based on the side-band bit stream. The window 172 may generate a windowed time-domain side channel by applying two asymmetric windows to each frame of the time-domain side channel. The transform device 174 may transform the windowed time-domain side channel to the transform domain to generate sets of transform-domain side channel data. The sets of transform-domain side channel data may include first transform-domain side channel data corresponding to a first side channel window of the first frame and second transform-domain side channel data corresponding to a second side channel window of the first frame. The up-mix operation described above may further be based on the sets of transform-domain side channel data.

Although the first device 104 and the second device 106 have been described as separate devices, in other implementations, the first device 104 may include one or more components described with reference to the second device 106. Additionally or alternatively, the second device 106 may include one or more components described with reference to the first device 104. For example, a single device may include the encoder 114, the decoder 118, the transmitter 110, the receiver 178, the one or more input interfaces 112, the one or more output interfaces 177, and a memory. The memory of the single device may include the first window parameters 152 that define a first window to be applied by the encoder 114 and the second window parameters 176 that define a second window to be applied by the decoder 176.

In a particular implementation, the second device 106 includes the receiver 178 configured to receive stereo parameters (e.g., the stereo cues 162) encoded, by the encoder 114 (of the first device 104), based on a plurality of analysis windows having a first length of overlapping portions between the plurality of analysis windows. The receiver 178 may also be configured to receive a mid-band signal, such as the mid-band bit stream 166 generated by the encoder 114 based on a downmix operation using the stereo parameters (e.g., the stereo cues 162) as described with reference to FIG. 2.

Figure 3:
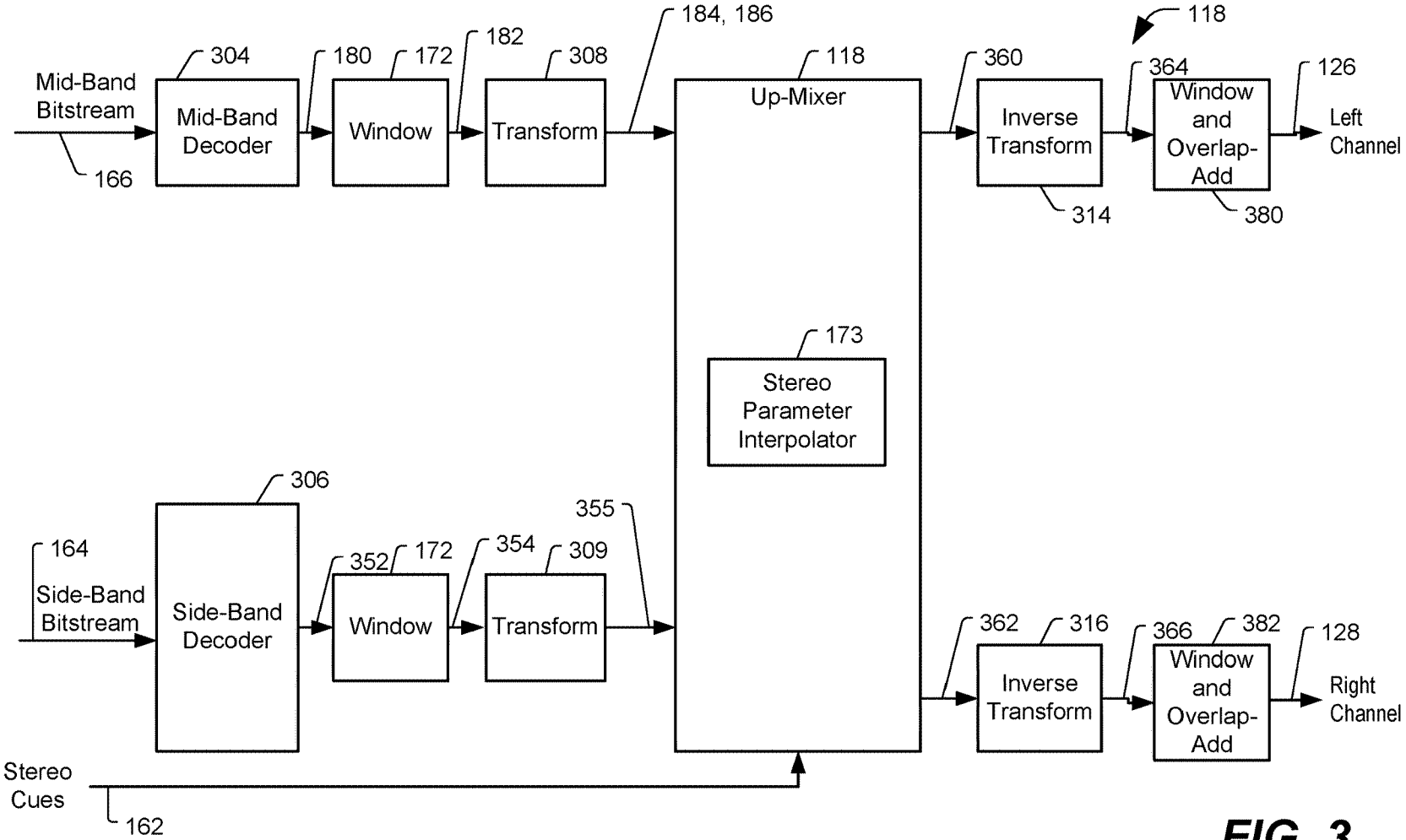
FIG. 3 is a diagram illustrating an example of the decoder of FIG. 1.

The second device 106 further includes the decoder 118 configured to perform an up-mix operation, as described further with reference to FIG. 3, using the stereo parameters to generate at least two audio signals, such as the first output signal 126 and the second output signal 128. The second plurality of analysis windows is configured to produce an inter-frame decoding delay that is less than a window overlap corresponding to the plurality of analysis windows. The at least two audio signals are generated based on a second plurality of analysis windows having a second length of overlapping portions between the second plurality of analysis windows. The second length is different from the first length. For example, the second length is less than the first length. In some implementations, the up-mix operation is performed using the stereo parameters and the mid-band signal. In some implementations, the receiver is configured to receive an audio signal that includes the stereo parameters, and the decoder 118 is configured to apply the second plurality of analysis windows during decoding of the audio signal to generate a windowed time-domain audio decoding signal.

In some implementations, the plurality of analysis windows is associated with a first hop length and the second plurality of analysis windows is associated with a second hop length. The first hop length is different from the second hop length. Additionally or alternatively, the plurality of analysis windows may include a different number of windows than the second plurality of analysis windows. In some implementations, a first window of the plurality of analysis windows and a second window of the second plurality of analysis windows are the same size. In a particular implementation, each window of the plurality of analysis windows is symmetric and a first particular window of the second plurality of analysis windows is asymmetric (e.g., individually or with respect to a second particular window of the second plurality of analysis windows).

In some implementations, a window overlap of the second plurality of analysis windows is asymmetric. Additionally or alternatively, a first window of a pair of consecutive windows of the plurality of analysis windows is asymmetric. A third length of a first overlap portion of the first window and the second window is different from a fourth length of a second overlap portion of the second window and a third window of a second pair of consecutive windows.

In some implementations, the second device 106 includes an encoder that is configured to apply the plurality of analysis windows during encoding of a second audio signal to generate a windowed time-domain audio encoding signal. The second device 106 may further includes a transmitter configured to transmit an output audio signal generated based on the windowed time-domain audio encoding signal.

The system 100 may reduce audio artifacts at the decoder 118. For example, the decoder 118 uses unevenly weighted smoothing based on the interpolation weights to reduce audio artifacts that may otherwise be present due to the asymmetric windows (e.g., the windows 191, 192). Unevenly weighted smoothing may be used with the asymmetric windows to offset the effect of unequal inner overlap (overlap of windows of a single frame) and outer overlap (overlap of a window of one frame with a window of an adjacent frame). The unevenly weighted smoothing applies unequal weights to determine a stereo parameter value to be applied to at least one of the set of transform domain data of a particular frame.

Figure 2:
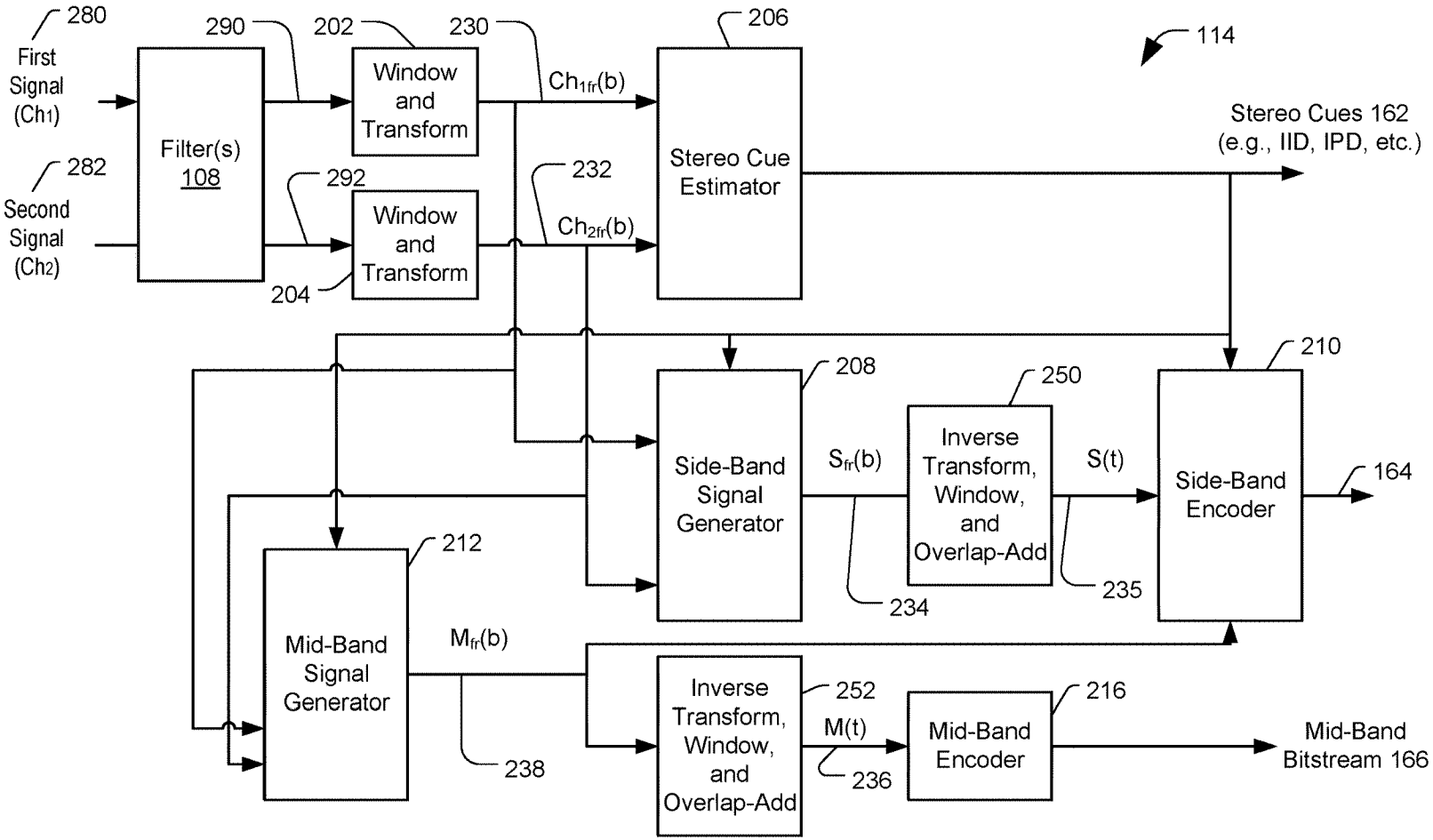
FIG. 2 is a diagram illustrating an example of the encoder of FIG. 1.

Referring to FIG. 2, a diagram illustrating a particular implementation of the encoder 114 is shown. A first signal 280 and a second signal 282 may correspond to a left-channel signal and a right-channel signal. In some implementations, one of the left-channel signal or the right-channel signal (the "adjusted target" signal) has been time-shifted relative to the other of the left-channel signal or the right-channel signal (the "reference" signal) to increase coding efficiency (e.g., to reduce side signal energy). In some examples, a reference signal 280 may include a left-channel signal and an adjusted target signal 282 may include a right-channel signal. However, it should be understood that in other examples, the reference signal 280 may include a right-channel signal and the adjusted target signal 282 may include a left-channel signal. In other implementations, the reference channel 280 may be either of the left or the right channel which is chosen on a frame-by-frame basis and similarly, the adjusted target signal 282 may be the other of the left or right channels after being adjusted for temporal shift. For the purposes of the descriptions below, an example is provided of the specific case when the reference signal 280 includes a left-channel signal (L) and the adjusted target signal 282 includes a right-channel signal (R). Similar descriptions for the other cases can be trivially extended. It is also to be understood that the various components illustrated in FIG. 2 (e.g., transforms, signal generators, encoders, estimators, etc.) may be implemented using hardware (e.g., dedicated circuitry), software (e.g., instructions executed by a processor), or a combination thereof.

The reference signal 280 and the adjusted target signal 282 may be provided to the filter 108 (e.g., the one or more filter-banks). The filter 108 may perform a resampling or high-pass filter operation on the signals 280, 282.

A window and transform 202 may be performed on the reference signal 290 and a window and transform 204 may be performed on the adjusted target signal 292. The windows and transforms 202, 204 may be performed by transform operations that generate frequency-domain (or sub-band domain or filtered low-band core and high-band bandwidth extension) signals. As non-limiting examples, performing the windows and transforms 202, 204 may include Discrete Fourier Transform (DFT) operations, Fast Fourier Transform (FFT) operations, modified discrete cosine transform (MDCT), etc. According to some implementations, Quadrature Mirror Filterbank (QMF) operations (using filterbands, such as a Complex Low Delay Filter Bank) may be used to split the input signals (e.g., the reference signal 290 and the adjusted target signal 292) into multiple sub-bands, and the sub-bands may be converted into the frequency-domain using another frequency-domain transform operation. The window and transform 202 may be applied to the reference signal 290 to generate a windowed frequency-domain reference signal ($L_{fr}(b)$) 230, and the window and transform 204 may be applied to the adjusted target signal 292 to generate a windowed frequency-domain adjusted target signal ($R_{fr}(b)$) 232. The windowed frequency-domain reference signal 230 and the windowed frequency-domain adjusted target signal 232 may be provided to a stereo cue estimator 206 and to a side-band signal generator 208.

The stereo cue estimator 206 may extract (e.g., generate) the stereo cues 162 based on the windowed frequency-domain reference signal 230 and the windowed frequency-domain adjusted target signal 232. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at an encoder may provide an estimate of the phase difference in the frequency-domain between the left and right channels in the band (b). The stereo cues 162 may include additional (or alternative) parameters, such as ICCs, ITDs etc. The stereo cues 162 may be transmitted to the second device 106 of FIG. 1, provided to the side-band signal generator 208, and provided to a side-band encoder 210.

The side-band generator 208 may generate a frequency-domain sideband signal ($S_{fr}(b)$) 234 based on the windowed frequency-domain reference signal 230 and the windowed frequency-domain adjusted target signal 232. The frequency-domain sideband signal 234 may be estimated in the frequency-domain bins/bands. In each band, the gain parameter (g) may be different and may be based on the inter-channel level differences (e.g., based on the stereo cues 162). For example, the frequency-domain sideband signal 234 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain sideband signal 234 may be provided to an inverse transform, window, and overlap-add unit 250. For example, the frequency-domain sideband signal 234 may be inverse-transformed back to time domain to generate a time-domain sideband signal S(t) 235, or transformed to MDCT domain, for coding. The time-domain sideband signal 235 may be provided to the side-band encoder 210.

The windowed frequency-domain reference signal 230 and the windowed frequency-domain adjusted target signal 232 may be provided to a mid-band signal generator 212. According to some implementations, the stereo cues 162 may also be provided to the mid-band signal generator 212. The mid-band signal generator 212 may generate a frequency-domain mid-band signal $M_{fr}(b)$ 238 based on the windowed frequency-domain reference signal 230 and the windowed frequency-domain adjusted target signal 232. According to some implementations, the frequency-domain mid-band signal $M_{fr}(b)$ 238 may be generated also based on the stereo cues 162. Some methods of generation of the mid-band signal 238 based on the windowed frequency domain reference channel 230, the windowed adjusted target channel 232 and the stereo cues 162 are as follows.

$$M_{fr}(b)=(L_{fr}(b)+R_{fr}(b))/2$$

$$M_{fr}(b)=C_1(b)*L_{fr}(b)+C_2*R_{fr}(b),$$ where $C_1(b)$ and $C_2(b)$ are complex values.

In some implementations, the complex values $C_1(b)$ and $C_2(b)$ are based on the stereo cues 162.

The frequency-domain mid-band signal 238 may be provided to an inverse transform, window, and overlap-add unit 252. For example, the frequency-domain mid-band signal 238 may be inverse-transformed to time domain to generate a time-domain mid-band signal 236, or transformed to MDCT domain, for coding. The time-domain mid-band signal 236 may be provided to a mid-band encoder 216, and the frequency-domain mid-band signal 238 may be provided to the side-band encoder 210 for the purpose of efficient side band signal encoding.

The side-band encoder 210 may generate the side-band bit stream 164 based on the stereo cues 162, the time-domain sideband signal 235, and the frequency-domain mid-band signal 238. The mid-band encoder 216 may generate the mid-band bit stream 166 based on the time-domain mid-band signal 236. For example, the mid-band encoder 216 may encode the time-domain mid-band signal 236 to generate the mid-band bit stream 166.

The windows and transforms 202 and 204 may be configured to apply a windowing scheme associated with the first window parameters 152 of FIG. 1. For example, the stereo cue parameters 162 may include parameter values computed based on the windowed samples 111 of FIG. 1. Additionally, the inverse transform, window, and overlap-add units 250, 252 may be configured to perform inverse transforms on windowed samples (generated using a windowing scheme associate with the first window parameters 152 of FIG. 1) to return frequency-domain signals to overlapping windowed time-domain signals.

In some implementations, one or more of the stereo cue estimator 206, the side-band generator 208, and the mid-band signal generator 212 may be included in a downmixer. Additionally or alternatively, although the encoder 114 is described as including the side-band encoder 210, in other implementations the encoder 114 may not include the side-band encoder 210.

Referring to FIG. 3, a diagram illustrating a particular implementation of the decoder 118 is shown. An encoded audio signal is provided to a demultiplexer (DEMUX) 302 of the decoder 118. The encoded audio signal may include the stereo cues 162, the side-band bit stream 164, and the mid-band bit stream 166. A demultiplexer (not shown) may be configured to extract the mid-band bit stream 166 from the encoded audio signal and provide the mid-band bit stream 166 to a mid-band decoder 304. The demultiplexer may also be configured to extract the side-band bit stream 164 and the stereo cues 162 from the encoded audio signal. The side-band bit stream 164 and the stereo cues 162 may be provided to a side-band decoder 306.

The mid-band decoder 304 may be configured to decode the mid-band bit stream 166 to generate the time-domain mid channel 180 (e.g., a mid-band signal ($m_{CODED}(t)$)). The time-domain mid channel 180 may be provided to the window 172. The window 172 may be configured to generate the windowed time-domain mid channel 182 by applying two asymmetric windows (e.g., the windows 191, 192) to each frame of the time-domain mid channel 180.

A transform 308 may be applied to the windowed time-domain mid channel 182. For example, the transform 308 may transform the windowed time-domain mid channel 182 to the transform domain to generate sets of transform-domain mid channel data (e.g., the first transform-domain mid channel data 184 and the second transform-domain mid channel data 186). The first transform-domain mid channel data 184 and the second transform-domain mid channel data 186 may be provided to an up-mixer 118.

The side-band decoder 306 may generate a time-domain side channel ($S_{CODED}(t)$) 352 based on the side-band bit stream 164 and the stereo cues 162. For example, the error (e) may be decoded for the low-bands and the high-bands. The time-domain side channel 352 may be expressed as $S_{PRED}(t)+e_{CODED}(t)$, where $S_{PRED}(t)=M_{CODED}(t)*(ILD(t)-1)/(ILD(t)+1)$. The time-domain side channel 354 may be provided to the window 172. The window 172 may be configured to generate a windowed time-domain side channel 354 by applying two asymmetric windows (e.g., the windows 191, 192) to each frame of the time-domain side channel 354.

A transform 309 may be applied to the windowed time-domain side channel 354. The transform 309 may transform the windowed time-domain side channel 354 to the transform domain to generate sets of transform-domain side channel data 355. The sets of transform-domain side channel data 355 may include first transform-domain side channel data corresponding to a first side channel window (e.g., window 191) of a first frame (e.g., frame 198) and second transform-domain side channel data corresponding to a second side channel window (e.g., window 192) of the first frame. The sets of transform-domain side channel data 355 may also be provided to the up-mixer 118.

The up-mixer 118 may be configured to perform an up-mix operation using the sets of transform-domain mid channel data 184, 186, the stereo parameters (e.g., the stereo cues 162) from the bit stream, the sets of transform-domain side channel data 355, and an interpolated stereo parameter determined using an unevenly weighted interpolation between the first stereo parameter value (x) associated with the first frame (e.g., frame 198) and the second stereo parameter value (y) associated with the second frame (e.g., frame 197). For example, the stereo parameter interpolator 173 may be configured to determine the first interpolated stereo parameter value 187 for the first mid channel window (e.g., the window 191) based on a sum of the first product and the second product. The first product may be based on a first interpolation weight ($\alpha$) and the first stereo parameter value (x), and the second product may be based on a second interpolation weight ($\beta$) and the second stereo parameter value (y). Thus, the first interpolated stereo parameter value 187 may be expressed as ($\alpha*x+\beta*y$). The first interpolation weight ($\alpha$) and the second interpolation weight ($\beta$) may be unequal such that the interpolation is unevenly weighted. The stereo parameter interpolator 173 may be configured to apply the first interpolated stereo parameter value 187 to the first mid channel window (e.g., the window 191) during the up-mix operation. For example, the stereo parameter interpolator 173 may apply an interpolated version of the stereo cues 162 (generated at the encoder 114) to the first mid channel window (e.g., to a frequency-domain signal).

The stereo parameter interpolator 173 may also be configured to determine the second interpolated stereo parameter value 188 for the second mid channel window (e.g., the window 192) based on a sum of a third product and a fourth product. The third product may be based on a third interpolation weight ($\delta$) and the first stereo parameter value (x), and the fourth product may be based on a fourth interpolation weight ($\lambda$) and the second stereo parameter value (y). Thus, the second interpolated stereo parameter value 188 may be expressed as ($\delta*x+\lambda*y$). The stereo parameter interpolator 173 may be configured to apply the second interpolated stereo parameter value 188 to the second mid channel window (e.g., the window 192) during the up-mix operation. For example, the decoder 118 may apply an interpolated version of the stereo cues 162 (generated at the encoder 114) to the second mid channel window (e.g., to a frequency-domain signal).

The third interpolation weight ($\delta$) may be greater than or equal to the first interpolation weight ($\alpha$), and the fourth interpolation weight ($\lambda$) may be less than the second interpolation weight ($\beta$). As a result, the second interpolated stereo parameter value 188 may be weighted heavier towards the first stereo parameter value (x) (e.g., the stereo parameter value associated with the frame 198), and the first interpolated stereo parameter value 187 may be weighted heavier towards the second stereo parameter value (y) (e.g., the stereo parameter value associated with the frame 197). According to one implementation, the third interpolation weight ($\delta$) is equal to one and the fourth interpolation weight ($\lambda$) is equal to zero. In this implementation, the second interpolated stereo parameter value 188 is equal to the first stereo parameter value (x). The first interpolation weight ($\alpha$), the second interpolation weight ($\beta$), the third interpolation weight ($\delta$), and the fourth interpolation weight ($\lambda$) may be distinct from the interpolation weights for corresponding windows used, the by encoder 114, to generate the bit stream.

After applying the interpolated version of the stereo cues 162, the up-mixer may generate signals 360, 362. For example, the interpolated version of the stereo cues 162 may be applied to the up-mixed left and right channels in the frequency-domain. When available, the IPD (phase differences) may be spread on the left and right channels to maintain the interchannel phase differences. An inverse transform 314 may be applied to the signal 360 to generate a first time-domain signal l(t) 364 (e.g., a left channel signal), and an inverse transform 316 may be applied to the signal 362 to generate a second time-domain signal r(t) 366 (e.g., a right channel signal). Non-limiting examples of the inverse transforms 314, 316 include Inverse Discrete Cosine Transform (IDCT) operations, Inverse Fast Fourier Transform (IFFT) operations, etc. A window and overlap-add 380, 382 may be applied to the signals 364, 366, respectively, to generate the first output signal 126 and the second output signal 128, respectively. The window and overlap-adds 380, 382 may apply two asymmetric windows to each frame of the signals 364, 366 in a similar manner as described above.

The window 172 may be configured to apply a windowing scheme associated with the second window parameters 176 of FIG. 1. The second windowing parameters 176 associated with the asymmetric windowing scheme used by the window 172 may be different from a symmetric windowing scheme used by an encoder, such as the encoder 114 of FIG. 1

It is noted that the encoder of FIG. 2 and the decoder of FIG. 3 may include a portion, but not all, of an encoder or decoder framework. For example, the encoder of FIG. 2, the decoder of FIG. 3, or both, may also include a parallel path of high band (HB) processing. Additionally or alternatively, in some implementations, a time domain downmix may be performed at the encoder of FIG. 2. Additionally or alternatively, a time domain up-mix may follow the decoder of FIG. 3 to obtain decoder shift compensated Left and Right channels.

Referring to FIG. 4, an example of an asymmetric windowing scheme implemented at a decoder is depicted. For example, a windowing scheme implemented by a decoder, such as the decoder 118 of FIG. 1, is depicted and generally designated 400. In some implementations, the windowing scheme 400 may be implemented based on the second window parameters 176.

The windowing scheme 400 may apply asymmetric windows to a frame (N−1) 402, a frame (N) 404, and a frame (N+1) 406. According to the windowing scheme 400, two asymmetric windows may be applied to each frame 402-406. To illustrate, an asymmetric window 412 may be applied to a first portion of the frame 404, and an asymmetric window 414 may be applied to a second portion of the frame 414. Additionally, an asymmetric window 410 may be applied to a second portion of the frame 402, and an asymmetric window 416 may be applied to a first portion of the frame 406. For ease of illustration, the asymmetric window applied to a first portion of the frame 402 is not shown, and the asymmetric window applied to a second portion of the frame 406 is not shown. The asymmetric windows 412, 414 may overlap to generate an inner overlap 430 for the frame 404. The asymmetric windows 414, 416 may overlap to generate an outer overlap 432 for the frame 404. Because the windows 412, 414, 416 are asymmetric, the inner overlap 430 is larger than the outer overlap 432 for the frame 404.

The stereo parameter interpolator 173 of FIG. 1 may determine a first interpolated stereo parameter value for the window 412 (e.g., a first mid channel window) based on a sum of a first product and a second product. The first product may be based on a first interpolation weight ($\alpha$) and a first stereo parameter value (x) associated with the frame 404, and the second product may be based on a second interpolation weight ($\beta$) and a second stereo parameter value (y) associated with the frame 402. Thus, the first interpolated stereo parameter value may be expressed as ($\alpha$*x+$\beta$*y). The first interpolation weight ($\alpha$) and the second interpolation weight ($\beta$) may be unequal such that the interpolation is unevenly weighted. The first interpolated stereo parameter value may be applied to the window 412 during an up-mix operation.

The stereo parameter interpolator 173 may also be configured to determine a second interpolated stereo parameter value for the window 414 (e.g., a second mid channel window) based on a sum of a third product and a fourth product. The third product may be based on a third interpolation weight ($\delta$) and the first stereo parameter value (x), and the fourth product may be based on a fourth interpolation weight ($\lambda$) and the second stereo parameter value (y). Thus, the second interpolated stereo parameter value 188 may be expressed as ($\delta$*x+$\lambda$*y). The second interpolated stereo parameter value may be applied to the window 414 during the up-mix operation.

The third interpolation weight ($\delta$) may be greater than or equal to the first interpolation weight ($\alpha$), and the fourth interpolation weight ($\lambda$) may be less than the second interpolation weight ($\beta$). As a result, the second interpolated stereo parameter value may be weighted heavier towards the first stereo parameter value (x) (e.g., the stereo parameter value associated with the frame 404), and the first interpolated stereo parameter value may be weighted heavier towards the second stereo parameter value (y) (e.g., the stereo parameter value associated with the frame 402). According to one implementation, the third interpolation weight ($\delta$) is equal to one and the fourth interpolation weight ($\lambda$) is equal to zero. In this implementation, the second interpolated stereo parameter value is equal to the first stereo parameter value (x). The first interpolation weight ($\alpha$), the second interpolation weight ($\beta$), the third interpolation weight ($\delta$), and the fourth interpolation weight ($\lambda$) may be distinct from the interpolation weights for corresponding windows used, the by encoder 114, to generate the bit stream.

Values of $\delta$ and $\lambda$ may be selected based on differences in size of the outer overlap 432 and the inner overlap 430. For example, since the inner overlap 430 of the windows 412, 414 of the frame 404 is larger than the outer overlap 432 of the windows 412, 414 of the frame 404, the value of $\delta$ may be less than the value of $\lambda$.

In certain implementations, the values of $\alpha$, $\beta$, $\delta$ and $\lambda$ may be selected based on the side band rejection amounts of the two overlapping portions of the inner and the outer overlap of the asymmetric windowing. The unevenly weighted interpolation may correspond to an overlap-dependent interpolation having interpolation weights (e.g., $\alpha$, $\beta$, $\delta$ and $\lambda$) selected based on an amount of overlap associated with asymmetric windows applied to frames of the time-domain mid channel 180. As an illustrative example, when the inner overlap is larger than the side band rejection amount of the outer overlap, the side band rejection amount of the inner overlap is larger than the outer overlap. In this illustrative example, a may be equal to one, and $\beta$ may be equal to zero. Because the side band rejection amount of the inner overlap is 'f' times the side band rejection amount of the outer overlap, $\delta$ and $\lambda$ can be chosen such that $\delta/\lambda$=f. If $\delta+\lambda=1$, $\delta=f/(1+f)$ and $\lambda=1/(1+f)$.

If a symmetric (e.g., evenly weighted) interpolation of the stereo parameters is performed when using an asymmetric windowing, a first slope pattern of the stereo parameter may result. The first slope pattern is represented by the dotted line 470. For example, if each window 412, 414 is evenly weighted (e.g., evenly weighted based on the stereo parameter value (x) and the stereo parameter value (y)), a slope 490 associated with the window 412 may be greater (e.g., steeper) than a slope 492 associated with the window 414. Also, the slope 490 may be greater (e.g., steeper) than the slope 492 when using symmetric interpolation for symmetric windowing (e.g., slope 496 or slope 498). However, if the asymmetric (e.g., unevenly weighted) interpolation of the stereo parameters is performed, a second slope pattern may result. The second slope pattern of parameter evolution is represented by the solid line 472. For example, if the windows 412, 414 are unevenly weighted, a slope 494 associated with the window 412 may be less than slope 490 and closer to the slope of parameter evolution seen when using symmetric interpolation for symmetric windowing (e.g., slope 496). Thus, the asymmetric interpolation of the stereo parameters reduces steep parameter evolution by keeping the slope value small at any of the overlapping portions. For example, the asymmetric interpolation of the stereo parameters for the asymmetric windows 412, 414 more closely mirrors the slopes 496, 498 associated with parameter evolution for symmetric windows.

Although the windowing scheme 400 describes the slope pattern as being linear, it should be noted that some of the parameter evolution may not be perfectly linear and could simply be a monotonously increasing/decreasing curve. Hence the patterns used (e.g., the slopes 490, 492, 494, 496 and 498) could also be curves that are monotonous. As used herein, the term "slope" is loosely defined in this context as an indicator of the amount of parameter variation relative to the amount of the overlapping portion over which this parameter variance occurs. According to one implementation, each interpolation weight associated with the unevenly weighted interpolation is selected to reduce an absolute value of the slope (e.g., the slopes 490, 492, 494, 496 and 498). As an illustration, the slope pattern shown in the second slope pattern 472 may be achieved when the values of $\beta$ and $\delta$ are set to 1 and the values of $\alpha$ and $\lambda$ are set to 0. In cases when $\alpha$is non zero, the second slope pattern 472 may also have two sets of slopes (one being slope 494 at the Inner overlap 430 and another slope 493 at the outer overlap between Frame N−1 and Frame N). In alternative implementations, the values of α, β, λ, and δ may be chosen such that the slope at the inner and the outer overlaps are equal. In these implementations, to achieve the same slope of parameter variance at both the overlaps, the amount of inner and the outer overlap are used to determine the interpolation factor set α, β, λ and δ.

The windowing scheme 400 uses unevenly weighted smoothing based on the interpolation weights to reduce audio artifacts that may otherwise be present due to the asymmetric windows (e.g., the windows 412, 414). Unevenly weighted smoothing may be used with the asymmetric windows 412, 414 to offset the effect of unequal inner overlap (overlap of windows of a single frame) and outer overlap (overlap of a window of one frame with a window of an adjacent frame). The unevenly weighted smoothing applies unequal weights to determine a stereo parameter value to be applied to at least one of the set of transform domain data of a particular frame.

Referring to FIG. 5, a flow chart of a particular illustrative example of a method of operating a decoder is disclosed and generally designated 500. The decoder may correspond to the decoder 118 of FIG. 1 or FIG. 3. For example, the method 500 may be performed by the second device 106 of FIG. 1.

The method 500 includes decoding, at a decoder, a bit stream to generate a time-domain mid channel, at 502. For example, referring to FIG. 1, the decoder 118 may be configured to decode the mid-band bit stream 166 to generate the time-domain mid channel 180.

The method 500 also includes generating a windowed time-domain mid channel by applying at least two first asymmetric windows to a first frame of the time-domain mid channel and by applying at least two second asymmetric windows to a second frame of the time-domain mid channel, at 504. For example, referring to FIG. 1, the window 172 may generate the windowed time-domain mid channel 182 by applying two asymmetric windows to each frame of the time-domain mid channel. The window 172 may use the second window parameters 176 to generate the windowed time-domain mid channel 182. To illustrate, an example of the asymmetric windowing scheme 190. According to an implementation associated with the time-domain mid channel 180, the windowing scheme 190 may be used in the time domain. For example, the time-domain mid channel 180 includes the frame (N−1) 197, the frame (N) 198, and the frame (N+1) 199. According to the windowing scheme 190, two asymmetric windows may be applied to each frame 197, 198, 199. To illustrate, the asymmetric window 191 may be applied to the first portion of the frame 198, and the asymmetric window 192 may be applied to a second portion of the frame 198.

The decoder 118 may select a set of interpolation weights. Based on the set of interpolation weights, a difference between an absolute value of a slope across different overlapping portions of the at least two first asymmetric windows and the at least two asymmetric windows is less than a difference if each interpolation weight is equal to 0.5. The slope indicates an amount of stereo parameter variation relative to an amount of asymmetric window overlap of the time-domain mid channel.

The method 500 also includes transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame, at 506. For example, referring to FIG. 1, the transform device 174 may transform the windowed time-domain mid channel 182 to the transform domain to generate sets of transform-domain mid channel data. As a non-limiting example, the transform device 174 may perform a Discrete Fourier Transform (DFT) operation to transform the windowed time-domain mid channel 182 to the transform domain (e.g., a DFT domain). According to one implementation, the sets of transform-domain mid channel data may include first transform-domain mid channel data 184 corresponding to a first mid channel window (e.g., window 191) of a first frame (e.g., frame 198) and second transform-domain mid channel data 186 corresponding to a second mid channel window (e.g., window 192) of the first frame.

The method 500 also includes performing an up-mix operation using the set of transform-domain mid channel data, the stereo parameters from the bit stream, and an interpolated stereo parameter determined using unevenly weighted interpolation between a first stereo parameter value associated with the first frame and a second stereo parameter value associated with the second frame, at 508. The second frame may be adjacent to the first frame. For example, referring to FIG. 1, decoder 118 may be perform the up-mix operation using the sets of transform-domain mid channel data, the stereo parameters (e.g., the stereo cues 162) from the bit stream, and an interpolated stereo parameter determined using an unevenly weighted interpolation between a first stereo parameter value (x) associated with the first frame (e.g., frame 198) and a second stereo parameter value (y) associated with a second frame (e.g., frame 197).

For example, the stereo parameter interpolator 173 may determine the first interpolated stereo parameter value 187 for the first mid channel window (e.g., the window 191) based on a sum of the first product and the second product. The first product may be based on the first interpolation weight (α) and the first stereo parameter value (x), and the second product may be based on the second interpolation weight 03) and the second stereo parameter value (y). Thus, the first interpolated stereo parameter value 187 may be expressed as (α*x+β*y). The first interpolation weight (α) and the second interpolation weight (β) may be unequal such that the interpolation is unevenly weighted. The decoder 118 may apply the first interpolated stereo parameter value 187 to the first mid channel window (e.g., the window 191) during the up-mix operation. For example, the decoder 118 may apply an interpolated version of the stereo cues 162 (generated at the encoder 114) to the first mid channel window (e.g., to a frequency-domain signal).

The stereo parameter interpolator 173 may also determine the second interpolated stereo parameter value 188 for the second mid channel window (e.g., the window 192) based on a sum of the third product and the fourth product. The third product may be based on the third interpolation weight (δ) and the first stereo parameter value (x), and the fourth product may be based on the fourth interpolation weight (λ) and the second stereo parameter value (y). Thus, the second interpolated stereo parameter value 188 may be expressed as (δ*x+λ*y). The decoder 118 may apply the second interpolated stereo parameter value 188 to the second mid channel window (e.g., the window 192) during the up-mix operation. For example, the decoder 118 may apply an interpolated version of the stereo cues 162 (generated at the encoder 114) to the second mid channel window (e.g., to a frequency-domain signal).

The third interpolation weight (δ) may be greater than or equal to the first interpolation weight (α), and the fourth interpolation weight (λ) may be less than the second interpolation weight (β). As a result, the second interpolated stereo parameter value 188 may be weighted heavier towards the first stereo parameter value (x) (e.g., the stereo parameter value associated with the frame 198), and the first interpolated stereo parameter value 187 may be weighted heavier towards the second stereo parameter value (y) (e.g., the stereo parameter value associated with the frame 197). According to one implementation, the third interpolation weight (δ) is equal to one and the fourth interpolation weight (λ) is equal to zero. In this implementation, the second interpolated stereo parameter value 188 is equal to the first stereo parameter value (x). The first interpolation weight (α), the second interpolation weight (β), the third interpolation weight (δ), and the fourth interpolation weight (λ) may be distinct from the interpolation weights for corresponding windows used, the by encoder 114, to generate the bit stream.

According to one implementation, the method 500 also includes generating left channel data and right channel data based on the up-mix operation. The method 500 may also include performing a first inverse transform operation on the left channel data to generate a left time-domain channel and performing a second inverse transform operation on the right channel data to generate a right time-domain channel. The method 500 may also include generating an output based on the left time-domain channel and the right time-domain channel.

According to one implementation of the method 500, a set of interpolation weights are selected to match an absolute value of a slope across different overlapping portions of the first asymmetric windows and the second asymmetric windows. The slope may indicate an amount of stereo parameter variation relative to an amount of asymmetric window overlap of the time-domain mid channel 180.

The method 500 may reduce audio artifacts at the decoder 118. For example, the decoder 118 uses unevenly weighted smoothing based on the interpolation weights to reduce audio artifacts that may otherwise be present due to the asymmetric windows (e.g., the windows 191, 192). Unevenly weighted smoothing may be used with the asymmetric windows to offset the effect of unequal inner overlap (overlap of windows of a single frame) and outer overlap (overlap of a window of one frame with a window of an adjacent frame). The unevenly weighted smoothing applies unequal weights to determine a stereo parameter value to be applied to at least one of the set of transform domain data of a particular frame.

In particular aspects, the method 500 of FIG. 5 may be implemented by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, the method 500 of FIG. 5 may be performed by a processor that executes instructions, as described with respect to FIG. 6.

Referring to FIG. 6, a block diagram of a particular illustrative example of a device (e.g., a wireless communication device) is depicted and generally designated 600. In various implementations, the device 600 may have more or fewer components than illustrated in FIG. 6. In an illustrative example, the device 600 may correspond to the system of FIG. 1. For example, the device 600 may correspond to the first device 104 or the second device 106 of FIG. 1. In an illustrative example, the device 600 may operate according to the method of FIG. 5.

In a particular implementation, the device 600 includes a processor 606 (e.g., a CPU). The device 600 may include one or more additional processors, such as a processor 610 (e.g., a DSP). The processor 610 may include a CODEC 608, such as a speech CODEC, a music CODEC, or a combination thereof. The processor 610 may include one or more components (e.g., circuitry) configured to perform operations of the speech/music CODEC 608. As another example, the processor 610 may be configured to execute one or more computer-readable instructions to perform the operations of the speech/music CODEC 608. Thus, the CODEC 608 may include hardware and software. Although the speech/music CODEC 608 is illustrated as a component of the processor 610, in other examples one or more components of the speech/music CODEC 608 may be included in the processor 606, a CODEC 634, another processing component, or a combination thereof.

The speech/music CODEC 608 may include a decoder 692, such as a vocoder decoder. For example, the decoder 692 may correspond to the decoder 118 of FIG. 1. In a particular aspect, the decoder 692 is configured to decode a bit stream to generate a time-domain mid channel. The decoder 692 may also be configured to generate a windowed time-domain mid channel by applying two asymmetric windows to each frame of the time-domain mid channel. The decoder 692 may further be configured to transform the windowed time-domain mid channel to a transform domain to generate sets of transform-domain mid channel data including first transform-domain mid channel data corresponding to a first mid channel window of a first frame and second transform-domain mid channel data corresponding to a second mid channel window of the first frame. The decoder 692 may also be configured to perform an up-mix operation using the sets of transform-domain mid channel data, stereo parameters from the bit stream, and an interpolated stereo parameter determined using unevenly weighted interpolation between a first stereo parameter value associated with the first frame and a second stereo parameter value associated with a second frame.

The decoder 692 may decode an encoded signal using sampling windows having a second window characteristic that is different from a first window characteristic of sampling windows used to encode the signal. For example, the decoder 692 may be configured to use sampling windows based on one or more stored window parameters 691 (e.g., the second window parameters 176 of FIG. 1). The speech/music CODEC 608 may include an encoder 691, such as the encoder 114 of FIG. 1. The encoder 691 may be configured to encode audio signals using sampling windows having the first window characteristic.

The device 600 may include a memory 632 and the CODEC 634. The CODEC 634 may include a digital-to-analog converter (DAC) 602 and an analog-to-digital converter (ADC) 604. A speaker 636, a microphone array 638, or both may be coupled to the CODEC 634. The CODEC 634 may receive analog signals from the microphone array 638, convert the analog signals to digital signals using the analog-to-digital converter 604, and provide the digital signals to the speech/music CODEC 608. The speech/music CODEC 608 may process the digital signals. In some implementations, the speech/music CODEC 608 may provide digital signals to the CODEC 634. The CODEC 634 may convert the digital signals to analog signals using the digital-to-analog converter 602 and may provide the analog signals to the speaker 636.

The device 600 may include a wireless controller 640 coupled, via a transceiver 650 (e.g., a transmitter, a receiver, or both), to an antenna 642. The device 600 may include the memory 632, such as a computer-readable storage device. The memory 632 may include instructions 660, such as one or more instructions that are executable by the processor 606, the processor 610, or a combination thereof, to perform one or more of the techniques described with respect to FIGS. 1-4, the method of FIG. 5, or a combination thereof.

As an illustrative example, the memory 632 may store instructions that, when executed by the processor 606, the processor 610, or a combination thereof, cause the processor 606, the processor 610, or a combination thereof, to perform operations including decoding a bit stream to generate a time-domain mid channel. The operations may also include generating a windowed time-domain mid channel by applying two asymmetric windows to each frame of the time-domain mid channel. The operations may also include transforming the windowed time-domain mid channel to a transform domain to generate sets of transform-domain mid channel data including first transform-domain mid channel data corresponding to a first mid channel window of a first frame and second transform-domain mid channel data corresponding to a second mid channel window of the first frame. The operations may also include perfuming an up-mix operation using the sets of transform-domain mid channel data, stereo parameters from the bit stream, and an interpolated stereo parameter determined using unevenly weighted interpolation between a first stereo parameter value associated with the first frame and a second stereo parameter value associated with a second frame.

In some implementations, the memory 632 may include code (e.g., interpreted or complied program instructions) that may be executed by the processor 606, the processor 610, or a combination thereof, to cause the processor 606, the processor 610, or a combination thereof, to perform functions as described with reference to the second device 106 of FIG. 1 or the decoder 118 of FIG. 1 or FIG. 3, to perform at least a portion of the method 500 of FIG. 5, or a combination thereof.

The memory 632 may include instructions 660 executable by the processor 606, the processor 610, the CODEC 634, another processing unit of the device 600, or a combination thereof, to perform methods and processes disclosed herein. One or more components of the system 100 of FIG. 1 may be implemented via dedicated hardware (e.g., circuitry), by a processor executing instructions (e.g., the instructions 660) to perform one or more tasks, or a combination thereof. As an example, the memory 632 or one or more components of the processor 606, the processor 610, the CODEC 634, or a combination thereof, may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 660) that, when executed by a computer (e.g., a processor in the CODEC 634, the processor 606, the processor 610, or a combination thereof), may cause the computer to perform at least a portion of the method of FIG. 5. As an example, the memory 632 or the one or more components of the processor 606, the processor 610, the CODEC 634 may be a non-transitory computer-readable medium that includes instructions (e.g., the instructions 660) that, when executed by a computer (e.g., a processor in the CODEC 634, the processor 606, the processor 610, or a combination thereof), cause the computer perform at least a portion of the method of FIG. 5, or a combination thereof.

In a particular implementation, the device 600 may be included in a system-in-package or system-on-chip device 622. In some implementations, the memory 632, the processor 606, the processor 610, the display controller 626, the CODEC 634, the wireless controller 640, and the transceiver 650 are included in a system-in-package or system-on-chip device 622. In some implementations, an input device 630 and a power supply 644 are coupled to the system-on-chip device 622. Moreover, in a particular implementation, as illustrated in FIG. 6, the display 628, the input device 630, the speaker 636, the microphone array 638, the antenna 642, and the power supply 644 are external to the system-on-chip device 622. In other implementations, each of the display 628, the input device 630, the speaker 636, the microphone array 638, the antenna 642, and the power supply 644 may be coupled to a component of the system-on-chip device 622, such as an interface or a controller of the system-on-chip device 622. In an illustrative example, the device 600 corresponds to a communication device, a mobile communication device, a smartphone, a cellular phone, a laptop computer, a computer, a tablet computer, a personal digital assistant, a set top box, a display device, a television, a gaming console, a music player, a radio, a digital video player, a digital video disc (DVD) player, an optical disc player, a tuner, a camera, a navigation device, a decoder system, an encoder system, a base station, a vehicle, or any combination thereof.

In conjunction with the described aspects, an apparatus may include means for decoding a bit stream to generate a time-domain mid channel. For example, the means for decoding may include or correspond to the decoder 118 of FIGS. 1 and 3, the decoder 692 of FIG. 6, the processor 606 of FIG. 6, 178 of FIG. 1, one or more other structures, devices, circuits, modules, or instructions to decode, or a combination thereof.

The apparatus may also include means for generating a windowed time-domain mid channel. The windowed time-domain mid channel is generated by applying at least two asymmetric windows to a first frame of the time-domain mid channel and by applying at least two asymmetric windows to a second frame of the time-domain mid channel. For example, the means for generating may include or correspond to the decoder 118 of FIGS. 1 and 3, the window 172 of FIGS. 1 and 3, the decoder 692 of FIG. 6, the processor 606 of FIG. 6, 178 of FIG. 1, one or more other structures, devices, circuits, modules, or instructions to generate the windowed time-domain mid channel, or a combination thereof.

The apparatus may also include means for transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame. For example, the means for transforming may include or correspond to the decoder 118 of FIGS. 1 and 3, the transform device 174 of FIG. 1, the transforms 308, 309 of FIG. 3, the decoder 692 of FIG. 6, the processor 606 of FIG.

6, 178 of FIG. 1, one or more other structures, devices, circuits, modules, or instructions to transform, or a combination thereof.

The apparatus may also include means for performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame. For example, the means for performing the up-mix operation may include or correspond to the decoder 118 of FIGS. 1 and 3, the stereo parameter interpolator 173 of FIGS. 1 and 3, the up-mixer 310 of FIG. 3, the decoder 692 of FIG. 6, the processor 606 of FIG. 6, 178 of FIG. 1, one or more other structures, devices, circuits, modules, or instructions to decode, or a combination thereof.

In the aspects of the description described above, various functions performed have been described as being performed by certain components or modules, such as components or module of the system 100 of FIG. 1. However, this division of components and modules is for illustration only. In alternative examples, a function performed by a particular component or module may instead be divided amongst multiple components or modules. Moreover, in other alternative examples, two or more components or modules of FIG. 1 may be integrated into a single component or module. Each component or module illustrated in FIG. 1 may be implemented using hardware (e.g., an ASIC, a DSP, a controller, a FPGA device, etc.), software (e.g., instructions executable by a processor), or any combination thereof.

Referring to FIG. 7, a block diagram of a particular illustrative example of a base station 700 is depicted. In various implementations, the base station 700 may have more components or fewer components than illustrated in FIG. 7. In an illustrative example, the base station 700 may operate according to the method 500 of FIG. 5.

The base station 700 may be part of a wireless communication system. The wireless communication system may include multiple base stations and multiple wireless devices. The wireless communication system may be a Long Term Evolution (LTE) system, a fourth generation (4G) LTE system, a fifth generation (5G) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 600 of FIG. 6.

Various functions may be performed by one or more components of the base station 700 (and/or in other components not shown), such as sending and receiving messages and data (e.g., audio data). In a particular example, the base station 700 includes a processor 706 (e.g., a CPU). The base station 700 may include a transcoder 710. The transcoder 710 may include an audio CODEC 708 (e.g., a speech and music CODEC). For example, the transcoder 710 may include one or more components (e.g., circuitry) configured to perform operations of the audio CODEC 708. As another example, the transcoder 710 is configured to execute one or more computer-readable instructions to perform the operations of the audio CODEC 708. Although the audio CODEC 708 is illustrated as a component of the transcoder 710, in other examples one or more components of the audio CODEC 708 may be included in the processor 706, another processing component, or a combination thereof. For example, the decoder 118 (e.g., a vocoder decoder) may be included in a receiver data processor 764. As another example, the encoder 114 (e.g., a vocoder encoder) may be included in a transmission data processor 782.

The transcoder 710 may function to transcode messages and data between two or more networks. The transcoder 710 is configured to convert message and audio data from a first format (e.g., a digital format) to a second format. To illustrate, the decoder 118 may decode encoded signals having a first format and the encoder 114 may encode the decoded signals into encoded signals having a second format. Additionally or alternatively, the transcoder 710 is configured to perform data rate adaptation. For example, the transcoder 710 may downconvert a data rate or upconvert the data rate without changing a format of the audio data. To illustrate, the transcoder 710 may downconvert 64 kbit/s signals into 16 kbit/s signals. The audio CODEC 708 may include the encoder 114 and the decoder 118. The decoder 118 may include the stereo parameter conditioner 618.

The base station 700 includes a memory 732. The memory 732 (an example of a computer-readable storage device) may include instructions. The instructions may include one or more instructions that are executable by the processor 706, the transcoder 710, or a combination thereof, to perform the method 500 of FIG. 5. The base station 700 may include multiple transmitters and receivers (e.g., transceivers), such as a first transceiver 752 and a second transceiver 754, coupled to an array of antennas. The array of antennas may include a first antenna 742 and a second antenna 744. The array of antennas is configured to wirelessly communicate with one or more wireless devices, such as the device 600 of FIG. 6. For example, the second antenna 744 may receive a data stream 714 (e.g., a bitstream) from a wireless device. The data stream 714 may include messages, data (e.g., encoded speech data), or a combination thereof.

The base station 700 may include a network connection 760, such as a backhaul connection. The network connection 760 is configured to communicate with a core network or one or more base stations of the wireless communication network. For example, the base station 700 may receive a second data stream (e.g., messages or audio data) from a core network via the network connection 760. The base station 700 may process the second data stream to generate messages or audio data and provide the messages or the audio data to one or more wireless devices via one or more antennas of the array of antennas or to another base station via the network connection 760. In a particular implementation, the network connection 760 may be a wide area network (WAN) connection, as an illustrative, non-limiting example. In some implementations, the core network may include or correspond to a Public Switched Telephone Network (PSTN), a packet backbone network, or both.

The base station 700 may include a media gateway 770 that is coupled to the network connection 760 and the processor 706. The media gateway 770 is configured to convert between media streams of different telecommunications technologies. For example, the media gateway 770 may convert between different transmission protocols, different coding schemes, or both. To illustrate, the media gateway 770 may convert from PCM signals to Real-Time Transport Protocol (RTP) signals, as an illustrative, non-limiting example. The media gateway 770 may convert data between packet switched networks (e.g., a Voice Over Internet Protocol (VoIP) network, an IP Multimedia Subsystem (IMS), a fourth generation (4G) wireless network, such as LTE, WiMax, and UMB, a fifth generation (5G) wireless network, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 770 may include a transcoder, such as the transcoder 710, and is configured to transcode data when codecs are incompatible. For example, the media gateway 770 may transcode between an Adaptive Multi-Rate (AMR) codec and a G.711 codec, as an illustrative, non-limiting example. The media gateway 770 may include a router and a plurality of physical interfaces. In some implementations, the media gateway 770 may also include a controller (not shown). In a particular implementation, the media gateway controller may be external to the media gateway 770, external to the base station 700, or both. The media gateway controller may control and coordinate operations of multiple media gateways. The media gateway 770 may receive control signals from the media gateway controller and may function to bridge between different transmission technologies and may add service to end-user capabilities and connections.

The base station 700 may include a demodulator 762 that is coupled to the transceivers 752, 754, the receiver data processor 764, and the processor 706, and the receiver data processor 764 may be coupled to the processor 706. The demodulator 762 is configured to demodulate modulated signals received from the transceivers 752, 754 and to provide demodulated data to the receiver data processor 764. The receiver data processor 764 is configured to extract a message or audio data from the demodulated data and send the message or the audio data to the processor 706.

The base station 700 may include a transmission data processor 782 and a transmission multiple input-multiple output (MIMO) processor 784. The transmission data processor 782 may be coupled to the processor 706 and to the transmission MIMO processor 784. The transmission MIMO processor 784 may be coupled to the transceivers 752, 754 and the processor 706. In some implementations, the transmission MIMO processor 784 may be coupled to the media gateway 770. The transmission data processor 782 is configured to receive the messages or the audio data from the processor 706 and to code the messages or the audio data based on a coding scheme, such as CDMA or orthogonal frequency-division multiplexing (OFDM), as an illustrative, non-limiting examples. The transmission data processor 782 may provide the coded data to the transmission MIMO processor 784.

The coded data may be multiplexed with other data, such as pilot data, using CDMA or OFDM techniques to generate multiplexed data. The multiplexed data may then be modulated (i.e., symbol mapped) by the transmission data processor 782 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 706.

The transmission MIMO processor 784 is configured to receive the modulation symbols from the transmission data processor 782 and may further process the modulation symbols and may perform beamforming on the data. For example, the transmission MIMO processor 784 may apply beamforming weights to the modulation symbols.

During operation, the second antenna 744 of the base station 700 may receive a data stream 714. The second transceiver 754 may receive the data stream 714 from the second antenna 744 and may provide the data stream 714 to the demodulator 762. The demodulator 762 may demodulate modulated signals of the data stream 714 and provide demodulated data to the receiver data processor 764. The receiver data processor 764 may extract audio data from the demodulated data and provide the extracted audio data to the processor 706.

The processor 706 may provide the audio data to the transcoder 710 for transcoding. The decoder 118 of the transcoder 710 may decode the audio data from a first format into decoded audio data, and the encoder 114 may encode the decoded audio data into a second format. In some implementations, the encoder 114 may encode the audio data using a higher data rate (e.g., upconvert) or a lower data rate (e.g., downconvert) than received from the wireless device. In other implementations, the audio data may not be transcoded. Although transcoding (e.g., decoding and encoding) is illustrated as being performed by a transcoder 710, the transcoding operations (e.g., decoding and encoding) may be performed by multiple components of the base station 700. For example, decoding may be performed by the receiver data processor 764 and encoding may be performed by the transmission data processor 782. In other implementations, the processor 706 may provide the audio data to the media gateway 770 for conversion to another transmission protocol, coding scheme, or both. The media gateway 770 may provide the converted data to another base station or core network via the network connection 760.

Encoded audio data generated at the encoder 114, such as transcoded data, may be provided to the transmission data processor 782 or the network connection 760 via the processor 706. The transcoded audio data from the transcoder 710 may be provided to the transmission data processor 782 for coding according to a modulation scheme, such as OFDM, to generate the modulation symbols. The transmission data processor 782 may provide the modulation symbols to the transmission MIMO processor 784 for further processing and beamforming. The transmission MIMO processor 784 may apply beamforming weights and may provide the modulation symbols to one or more antennas of the array of antennas, such as the first antenna 742 via the first transceiver 752. Thus, the base station 700 may provide a transcoded data stream 716, that corresponds to the data stream 714 received from the wireless device, to another wireless device. The transcoded data stream 716 may have a different encoding format, data rate, or both, than the data stream 714. In other implementations, the transcoded data stream 716 may be provided to the network connection 760 for transmission to another base station or a core network.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the aspects disclosed herein may be included directly in hardware, in a software module executed by a processor, or in a combination of the two. A software module may reside in RAM, flash memory, ROM, PROM, EPROM, EEPROM, registers, hard disk, a removable disk, a CD-ROM, or any other form of non-transient storage medium known in the art. A particular storage medium may be coupled to the processor such that the processor may read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein and is to be accorded the widest scope possible consistent with the principles and novel features as defined by the following claims.

What is claimed is:

1. A device comprising:

a decoder configured to:

decode a bit stream to generate a time-domain mid channel;

generate a windowed time-domain mid channel by:

application of at least two first asymmetric windows to a first frame of the time-domain mid channel; and application of at least two second asymmetric windows to a second frame of the time-domain mid channel;

transform the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame; and perform an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame, wherein the second frame is adjacent to the first frame.

2. The device of claim 1, wherein the decoder is further configured to:

determine a first interpolated stereo parameter value for the first mid channel window based on a sum of a first product and a second product, the first product based on a first interpolation weight and the first stereo parameter value, the second product based on a second interpolation weight and the second stereo parameter value, wherein the first interpolation weight is not equal to the second interpolation weight; and apply the first interpolated stereo parameter value to the first mid channel window during the up-mix operation.

3. The device of claim 2, wherein the first interpolation weight is equal to one, and wherein the second interpolation weight is equal to zero.

4. The device of claim 2, wherein the first interpolation weight is equal to zero, and wherein the second interpolation weight is equal to one.

5. The device of claim 2, wherein at least a portion of the first mid channel window extends to the second frame.

6. The device of claim 2, wherein the decoder is further configured to:

determine a second interpolated stereo parameter value for the second mid channel window based on a sum of a third product and a fourth product, the third product based on a third interpolation weight and the first stereo parameter value, and the fourth product based on a fourth interpolation weight and the second stereo parameter value, the third interpolation weight greater than or equal to the first interpolation weight, and the fourth interpolation weight less than the second interpolation weight; and apply the second interpolated stereo parameter value to the second mid channel window during the up-mix operation.

7. The device of claim 6, wherein the second mid channel window does not overlap the second frame.

8. The device of claim 6, wherein the third interpolation weight is equal to one, and wherein the fourth interpolation weight is equal to zero.

9. The device of claim 6, wherein the first interpolation weight, the second interpolation weight, the third interpolation weight, and the fourth interpolation weight are distinct from corresponding interpolation weights for windows used, by an encoder, to generate the bit stream.

10. The device of claim 1, wherein the unevenly weighted interpolation corresponds to an overlap-dependent interpolation having interpolation weights selected based on an amount of overlap associated with asymmetric windows applied to frames of the time-domain mid channel.

11. The device of claim 1, wherein each interpolation weight associated with the unevenly weighted interpolation is selected to reduce an absolute value of a slope, the slope indicating an amount of stereo parameter variation relative to an amount of asymmetric window overlap of the time-domain mid channel.

12. The device of claim 1, wherein a set of interpolation weights are selected to match an absolute value of a slope across different overlapping portions of the first asymmetric windows and the second asymmetric windows, the slope indicating an amount of stereo parameter variation relative to an amount of asymmetric window overlap of the time-domain mid channel.

13. The device of claim 12, wherein the set of interpolation weights are selected based on a coder type and based on signal characteristics of the first frame of the time-domain mid channel and the second frame of the time-domain mid channel.

14. The device of claim 1, wherein the decoder is further configured to select a set of interpolation weights, wherein based on the set of interpolation weights, a difference between an absolute value of a slope across different overlapping portions of the at least two first asymmetric windows and the at least two second asymmetric windows is less than a difference if each interpolation weight is equal to 0.5, the slope indicating an amount of stereo parameter variation relative to an amount of asymmetric window overlap of the time-domain mid channel.

15. The device of claim 1, wherein the stereo parameters include at least one of interchannel intensity difference (IID) parameters, interchannel time difference (ITD) parameters, interchannel phase difference (IPD) parameters, interchannel correlation (ICC) parameters, non-causal shift parameters, spectral tilt parameters, inter-channel voicing parameters, inter-channel pitch parameters, or inter-channel gain parameters.

16. The device of claim 1, wherein the decoder is further configured to perform a Discrete Fourier Transform (DFT) operation to transform the windowed time-domain mid channel to the transform domain.

17. The device of claim 1, wherein the decoder is further configured to:

generate left channel data and right channel data based on the up-mix operation;

perform a first inverse transform operation on the left channel data to generate a left time-domain channel;

perform a second inverse transform operation on the right channel data to generate a right time-domain channel; and generate an output based on the left time-domain channel and the right time-domain channel.

18. The device of claim 17, wherein the first inverse transform operation includes a first Inverse Discrete Fourier Transform (IDFT) operation, and wherein the second inverse transform operation includes a second IDFT operation.

19. The device of claim 1, wherein the decoder is further configured to:

generate a time-domain side channel based on the bit stream;

generate a windowed time-domain side channel by applying two asymmetric windows to each frame of the time-domain side channel; and transform the windowed time-domain side channel to the transform domain to generate sets of transform-domain side channel data including first transform-domain side channel data corresponding to a first side channel window of the first frame and second transform-domain side channel data corresponding to a second side channel window of the first frame, wherein the up-mix operation is further based on the sets of transform-domain side channel data.

20. The device of claim 1, wherein the decoder is integrated into a base station.

21. The device of claim 1, wherein the decoder is integrated into a mobile device.

22. A method comprising:

decoding, at a decoder, a bit stream to generate a time-domain mid channel;

generating a windowed time-domain mid channel by:

applying at least two first asymmetric windows to a first frame of the time-domain mid channel; and applying at least two second asymmetric windows to a second frame of the time-domain mid channel;

transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame; and performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame, wherein the second frame is adjacent to the first frame.

23. The method of claim 22, further comprising:

determining a first interpolated stereo parameter value for the first mid channel window based on a sum of a first product and a second product, the first product based on a first interpolation weight and the first stereo parameter value, the second product based on a second interpolation weight and the second stereo parameter value, wherein the first interpolation weight is not equal to the second interpolation weight; and applying the first interpolated stereo parameter value to the first mid channel window during the up-mix operation.

24. The method of claim 23, wherein the first interpolation weight is equal to one, and wherein the second interpolation weight is equal to zero.

25. The method of claim 23, wherein the first interpolation weight is equal to zero, and wherein the second interpolation weight is equal to one.

26. The method of claim 23, wherein at least a portion of the first mid channel window overlaps a portion of the second frame.

27. The method of claim 23, further comprising:

determining a second interpolated stereo parameter value for the second mid channel window based on a sum of a third product and a fourth product, the third product based on a third interpolation weight and the first stereo parameter value, and the fourth product based on a fourth interpolation weight and the second stereo parameter value, the third interpolation weight greater than or equal to the first interpolation weight, and the fourth interpolation weight less than the second interpolation weight; and applying the second interpolated stereo parameter value to the second mid channel window during the up-mix operation.

28. The method of claim 27, wherein the second mid channel window does not overlap the second frame.

29. The method of claim 27, wherein the third interpolation weight is equal to one, and wherein the fourth interpolation weight is equal to zero.

30. The method of claim 27, wherein the first interpolation weight, the second interpolation weight, the third interpolation weight, and the fourth interpolation weight are distinct from interpolation weights for corresponding windows used, by an encoder, to generate the bit stream.

31. The method of claim 22, wherein the stereo parameters include at least one of interchannel intensity difference (IID) parameters, interchannel time difference (ITD) parameters, interchannel phase difference (IPD) parameters, interchannel correlation (ICC) parameters, non-causal shift parameters, spectral tilt parameters, inter-channel voicing parameters, inter-channel pitch parameters, or inter-channel gain parameters.

32. The method of claim 22, further comprising performing a Discrete Fourier Transform (DFT) operation to transform the windowed time-domain mid channel to the transform domain.

33. The method of claim 22, further comprising:

generating left channel data and right channel data based on the up-mix operation;

performing a first inverse transform operation on the left channel data to generate a left time-domain channel;

performing a second inverse transform operation on the right channel data to generate a right time-domain channel; and generating an output based on the left time-domain channel and the right time-domain channel.

34. The method of claim 33, wherein the first inverse transform operation includes a first Inverse Discrete Fourier Transform (IDFT) operation, and wherein the second inverse transform operation includes a second IDFT operation.

35. The method of claim 22, further comprising:

generating a time-domain side channel based on the bit stream;

generating a windowed time-domain side channel by applying two asymmetric windows to each frame of the time-domain side channel; and transforming the windowed time-domain side channel to the transform domain to generate sets of transform-domain side channel data including first transform-domain side channel data corresponding to a first side channel window of the first frame and second transform-domain side channel data corresponding to a second side channel window of the first frame, wherein the up-mix operation is further based on the sets of transform-domain side channel data.

36. The method of claim 22, wherein the up-mix operation is performed at a base station.

37. The method of claim 22, wherein the up-mix operation is performed at a mobile device.

38. A non-transitory computer-readable medium comprising instructions that, when executed by a processor, cause the processor to perform operations comprising:

decoding, at a decoder, a bit stream to generate a time-domain mid channel;

generating a windowed time-domain mid channel by:

applying at least two first asymmetric windows to a first frame of the time-domain mid channel; and applying at least two second asymmetric windows to a second frame of the time-domain mid channel;

transforming the windowed time-domain mid channel to a transform domain to generate sets of transform-domain mid channel data including first transform-domain mid channel data corresponding to a first mid channel window of the first frame and second transform-domain mid channel data corresponding to a second mid channel window of the first frame; and performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame, wherein the second frame is adjacent to the first frame.

39. The non-transitory computer-readable medium of claim 38, wherein the operations further comprise:

determining a first interpolated stereo parameter value for the first mid channel window based on a sum of a first product and a second product, the first product based on a first interpolation weight and the first stereo parameter value, the second product based on a second interpolation weight and the second stereo parameter value, wherein the first interpolation weight is not equal to the second interpolation weight; and applying the first interpolated stereo parameter value to the first mid channel window during the up-mix operation.

40. The non-transitory computer-readable medium of claim 39, wherein at least a portion of the first mid channel window extends to the second frame.

41. The non-transitory computer-readable medium of claim 39, wherein the operations further comprise:

determining a second interpolated stereo parameter value for the second mid channel window based on a sum of a third product and a fourth product, the third product based on a third interpolation weight and the first stereo parameter value, and the fourth product based on a fourth interpolation weight and the second stereo parameter value, the third interpolation weight greater than or equal to the first interpolation weight, and the fourth interpolation weight less than the second interpolation weight; and applying the second interpolated stereo parameter value to the second mid channel window during the up-mix operation.

42. The non-transitory computer-readable medium of claim 41, wherein the second mid channel window does not overlap the second frame.

43. The non-transitory computer-readable medium of claim 41, wherein the third interpolation weight is equal to one, and wherein the fourth interpolation weight is equal to zero.

44. The non-transitory computer-readable medium of claim 41, wherein the first interpolation weight, the second interpolation weight, the third interpolation weight, and the fourth interpolation weight are distinct from corresponding interpolation weights for windows used, by an encoder, to generate the bit stream.

45. An apparatus comprising:

means for decoding a bit stream to generate a time-domain mid channel;

means for generating a windowed time-domain mid channel, the windowed time-domain mid channel generated by:

applying at least two first asymmetric windows to a first frame of the time-domain mid channel; and applying at least two second asymmetric windows to a second frame of the time-domain mid channel;

means for transforming the windowed time-domain mid channel to a transform-domain to generate sets of transform-domain mid channel data including first transform-domain mid channel data corresponding to a first mid channel window of the first frame and second transform-domain mid channel data corresponding to a second mid channel window of the first frame; and means for performing an up-mix operation using the sets of transform-domain mid channel data, stereo parameters from the bit stream, and an interpolated stereo parameter determined using an unevenly weighted interpolation between a first stereo parameter value associated with the first frame and a second stereo parameter value associated with the second frame, wherein the second frame is adjacent to the first frame.

46. The apparatus of claim 45, further comprising:

means for determining a first interpolated stereo parameter value for the first mid channel window based on a sum of a first product and a second product, the first product based on a first interpolation weight and the first stereo parameter value, the second product based on a second interpolation weight and the second stereo parameter value, wherein the first interpolation weight is not equal to the second interpolation weight; and means for applying the first interpolated stereo parameter value to the first mid channel window during the up-mix operation.

47. The apparatus of claim 46, wherein at least a portion of the first mid channel window extends to the second frame.

48. The apparatus of claim 46, further comprising:

means for determining a second interpolated stereo parameter value for the second mid channel window based on a sum of a third product and a fourth product, the third product based on a third interpolation weight and the first stereo parameter value, and the fourth product based on a fourth interpolation weight and the second stereo parameter value, the third interpolation weight greater than or equal to the first interpolation weight, and the fourth interpolation weight less than the second interpolation weight; and means for applying the second interpolated stereo parameter value to the second mid channel window during the up-mix operation.

49. The apparatus of claim 48, wherein the second mid channel window does not overlap the second frame.

50. The apparatus of claim 45, wherein the means for performing the up-mix operation is integrated into a base station.

51. The apparatus of claim 45, wherein the means for performing the up-mix operation is integrated into a mobile device.

* * * * *